US012121143B2

(12) United States Patent
Nye

(10) Patent No.: US 12,121,143 B2
(45) **Date of Patent: *Oct. 22, 2024**

(54) LEG ASSEMBLIES

(71) Applicant: Lifetime Products, Inc., Clearfield, UT (US)

(72) Inventor: S. Curtis Nye, Clinton, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/449,451

(22) Filed: Aug. 14, 2023

(65) Prior Publication Data

US 2023/0380583 A1 Nov. 30, 2023

Related U.S. Application Data

(63) Continuation of application No. 17/499,227, filed on Oct. 12, 2021, now Pat. No. 11,723,454, which is a (Continued)

(51) Int. Cl.
*A47B 3/08* (2006.01)
*A47B 3/087* (2006.01)

(52) U.S. Cl.
CPC ..... *A47B 3/0818* (2013.01); *A47B 3/0815* (2013.01); *A47B 3/087* (2013.01)

(58) Field of Classification Search
CPC ..... A47B 3/0818; A47B 3/087; A47B 3/091; A47B 3/0912; A47B 3/0916; A47B 3/0915; A47B 3/0815
(Continued)

(56) References Cited

U.S. PATENT DOCUMENTS 236,197 A 1/1881 Valley
1,778,124 A 10/1930 Sauer
(Continued)

FOREIGN PATENT DOCUMENTS

CN 101557732 10/2009
CN 208658157 3/2019
(Continued)

OTHER PUBLICATIONS

PCT Application No. PCT/US2020/033327 International Search Report and Written opinion mailed Jul. 3, 2020.

*Primary Examiner* — Jose V Chen
(74) *Attorney, Agent, or Firm* — Maschoff Brennan

(57) ABSTRACT

A table may include a tabletop, a frame, and a leg assembly. The leg assembly may include a support element, a translation mechanism, and a lock device. The support element may include an end structure attached to an elongated structure. The end structure may be rotatably coupled to the frame such that the support element is rotatable relative to the frame between a first position and a second position. The translation mechanism may be retained relative to the support element and the frame. The translation mechanism may be configured to translate along the support element as the support element rotates. The lock device may be configurable in an engaged arrangement in which the lock device fixes the translation mechanism to the support element and in a disengaged arrangement in which the translation mechanism is not fixed relative to the support element.

20 Claims, 31 Drawing Sheets

Related U.S. Application Data continuation of application No. 16/876,037, filed on May 16, 2020, now Pat. No. 11,140,976.

(60) Provisional application No. 62/849,817, filed on May 17, 2019.

(58) Field of Classification Search
USPC ..... 108/130, 131, 132, 133
See application file for complete search history.

(56) References Cited

U.S. PATENT DOCUMENTS 1,923,067 A 8/1933 Corduan
2,875,007 A 2/1959 Fox
4,974,871 A 12/1990 Mao
5,941,181 A 8/1999 Hornberger et al.
6,892,860 B2 5/2005 Gibson et al.
6,912,961 B2 7/2005 Winter et al.
6,968,789 B2 11/2005 Baik et al.
7,051,662 B2 5/2006 Shenghao et al.
7,059,254 B2 6/2006 Strong et al.
7,069,865 B2 7/2006 Strong et al.
7,096,799 B2 8/2006 Strong et al.
7,111,563 B2 9/2006 Strong
7,278,361 B2 10/2007 Zhurong et al.
7,331,297 B2 2/2008 Strong et al.
7,469,646 B2 12/2008 Baik et al.
7,475,642 B2 1/2009 Shenghao et al.
7,475,643 B2 1/2009 Haney et al.
7,475,644 B2 1/2009 Strong et al.
7,509,914 B2 3/2009 Murphy
7,549,381 B1 6/2009 Nail et al.
7,640,870 B2 1/2010 Strong et al.
7,644,667 B2 1/2010 Strong et al.
D619,831 S 7/2010 Branch
7,905,185 B2 3/2011 Peery et al.
D640,487 S 6/2011 Bennett
7,971,930 B2 7/2011 Larsen et al.
8,006,630 B2 8/2011 Strong et al.
8,033,228 B2 10/2011 Haney et al.
8,132,517 B2 3/2012 Leng
8,156,875 B2 4/2012 Neunzert et al.
D658,912 S 5/2012 Winter et al.
D659,450 S 5/2012 Winter et al.
8,166,894 B1 5/2012 Branch et al.
D662,736 S 7/2012 Peery et al.
D662,738 S 7/2012 Winter et al.
D667,659 S 9/2012 Winter et al.
D668,483 S 10/2012 Bennett
8,302,541 B2 11/2012 Haney et al.
D671,773 S 12/2012 Johnson et al.
D671,775 S 12/2012 Clegg et al.
D671,776 S 12/2012 Clegg et al.
D672,175 S 12/2012 Peery et al.
8,342,107 B2 1/2013 Mower et al.
8,347,795 B2 1/2013 Peery et al.
8,397,652 B2 3/2013 Peery et al.
8,397,653 B2 3/2013 Ashby et al.
8,408,146 B2 4/2013 Peery et al.
D681,982 S 5/2013 Clegg et al.
D682,586 S 5/2013 Clegg et al.
D683,985 S 6/2013 Nye et al.
D688,496 S 8/2013 Bennett
8,534,205 B1 9/2013 Johnson et al.
8,544,393 B2 10/2013 Branch et al.
8,555,789 B2 10/2013 Jin et al.
8,555,790 B2 10/2013 Winter et al.
8,555,791 B2 10/2013 Jin et al.
8,578,863 B2 11/2013 Peery et al.
8,578,865 B2 11/2013 Haney et al.
D696,882 S 1/2014 Clegg et al.
8,622,007 B2 1/2014 Peery et al.
D700,465 S 3/2014 Johnson et al.
8,683,929 B2 4/2014 Peery et al.
8,720,990 B2 5/2014 Boydston
8,726,817 B2 5/2014 Bennett et al.
8,746,155 B2 6/2014 Haney et al.
8,757,069 B2 6/2014 Peery et al.
D708,462 S 7/2014 Nye et al.
D715,081 S 10/2014 Bennett
8,857,349 B2 10/2014 Peery et al.
8,904,943 B2 12/2014 Jin et al.
8,943,982 B2 2/2015 Peery et al.
D727,074 S 4/2015 Johnson et al.
8,997,663 B2 4/2015 Peery et al.
D734,081 S 7/2015 Johnson et al.
9,101,209 B2 8/2015 Bennett et al.
D739,672 S 9/2015 Johnson et al.
9,138,050 B2 9/2015 Peery et al.
9,173,482 B2 11/2015 Peery et al.
9,192,229 B2 11/2015 Peery et al.
9,192,230 B2 11/2015 Clegg et al.
D748,418 S 2/2016 Johnson et al.
9,277,808 B2 3/2016 Cai et al.
9,307,831 B2 4/2016 Peery et al.
9,351,563 B2 5/2016 Bennett et al.
D759,411 S 6/2016 Johnson et al.
9,486,076 B2 11/2016 Peery et al.
9,532,644 B2 1/2017 Nye et al.
9,549,612 B2 1/2017 Peery et al.
9,591,918 B2 3/2017 Nye et al.
9,642,459 B2 5/2017 Peery et al.
9,661,916 B2 5/2017 Peery et al.
9,730,514 B2 8/2017 Peery
9,763,513 B2 9/2017 Cai et al.
9,763,517 B2 9/2017 Peery et al.
9,848,699 B2 12/2017 Peery et al.
D863,853 S 10/2019 Johnson et al.
D864,637 S 10/2019 Johnson et al.
10,470,561 B2 11/2019 Clegg et al.
10,485,333 B1 11/2019 Tan
11,140,976 B2 10/2021 Nye
11,723,454 B2 * 8/2023 Nye ..... A47B 3/0818 108/132
2001/0029875 A1 10/2001 Rumph
2002/0134285 A1 9/2002 Bruschi et al.
2003/0089286 A1 5/2003 Wang
2003/0167980 A1 9/2003 Suzuki
2005/0235886 A1 10/2005 Koning et al.
2006/0021553 A1 2/2006 Pleiman et al.
2010/0175598 A1 7/2010 Ballendat
2013/0233210 A1 9/2013 Jin et al.
2020/0154881 A1 5/2020 Applegate et al.
2020/0214440 A1 7/2020 Johnson et al.
2021/0007474 A1 1/2021 Nye

FOREIGN PATENT DOCUMENTS

DE 202010009267 U1 10/2010
EP 1145655 A1 10/2001
FR 2807632 A1 10/2001
WO 2018150447 A1 8/2018

* cited by examiner

LEG ASSEMBLIES

CROSS-REFERENCE TO RELATED APPLICATION

This application is a continuation patent application of U.S. patent application Ser. No. 17/499,227, filed Oct. 12, 2021, now U.S. Pat. No. 11,723,454, which is a continuation of U.S. patent application Ser. No. 16/876,037, filed May 16, 2020, now U.S. Pat. No. 11,140,976, issued Oct. 12, 2021, which claims priority to and the benefit of U.S. Provisional Patent Application Ser. No. 62/849,817, entitled LEG ASSEMBLIES, which was filed on May 17, 2019, each of which is incorporated by reference in its entirety.

BACKGROUND

Field of the Invention

The present invention generally relates to structures such as furniture and, in particular, to leg assemblies that may be implemented in furniture, such as tables and benches, and other structures.

Description of Related Art

Many different types of tables are well known and used for a variety of different purposes. For example, conventional tables may include legs that are pivotally attached to a tabletop and the legs may be movable between a use position in which the legs extend outwardly from the tabletop and a storage position in which the legs are folded against the tabletop. Conventional tables with relatively large tabletops and folding legs are often referred to as "banquet tables" and these tables are frequently used in assembly halls, banquet halls, convention centers, hotels, schools, churches, and other locations where large groups of people meet. These types of tables can often be positioned in an assortment of different configurations and used in a variety of settings. When the banquet tables are no longer needed, the table legs can be moved into the storage position and the tables may be more easily moved or stored.

Because most banquet tables have a length between six and ten feet and a width between three and four feet, the required storage area for such tables is quite large even with the legs in the collapsed position. This large storage area may be problematic for businesses or facilities such as hotels, schools, and churches because a considerable number of these tables may have to be stored.

Conventional tables often include tabletops constructed from materials such as wood, particle board or metal. Tabletops constructed from wood, particle board or metal, however, are often relatively heavy and this may make the table awkward or difficult to move. Tabletops constructed from wood or metal are also relatively expensive and these types of tabletops must generally be treated or finished before use. For example, tabletops constructed from wood must generally be sanded and painted, and metal tabletops must be formed into the desired shape and painted. In addition, because these wooden and metal tabletops are relatively heavy, the cost of shipping and transportation of the tables may be increased. The weight of the tabletop may make the tables more difficult to move and store.

In order to decrease the weight of conventional tables, tabletops may be constructed from relatively light-weight materials such as plastic. Disadvantageously, tabletops constructed from light-weight materials may require large reinforcing members or other structural parts such as braces, brackets, support members and the like to strengthen the tabletop. While these additional parts may increase the strength of the tabletop, the added parts may also increase the weight of the table. These additional parts may result in increased manufacturing costs and require additional time to assemble the table. In addition, extra fasteners may be required to assemble and connect these parts to the table, which may require extra time and labor during the manufacturing process. The additional parts and fasteners may further increase the cost of the table and make the table more difficult to manufacture. Moreover, these additional parts and fasteners may have sharp edges that can injure a user's legs or arms.

Conventional tables may include a frame that is connected to the tabletop. The frame may include a pair of side rails connected to sides of the tabletop using fasteners. Multiple fasteners may be required to securely connect the frame to the tabletop and transmit forces applied to the tabletop to the frame. Undesirably, when a relatively large load or force is applied to some known tables, the frame may bend, deform and/or detach from the tabletop. In addition, the fasteners used to connect the frame to the tabletop may detach or separate from the tabletop. The fasteners may even damage and tear through the tabletop if the load or force exceeds a certain amount. Further, the frames or fasteners of some known tables may collapse in some circumstances.

Additionally, conventional tables often include components that are used to stabilize the table. For example, these components may secure the legs in the use position and these components may extend into the volume below the tabletop. The components may restrict or limit a user's placement of his or her legs below the tabletop, restrict a number of chairs that may be placed below the tabletop, or restrict a number of users who can comfortably sit at the table.

The subject matter claimed herein is not limited to embodiments that solve any disadvantages or that operate only in environments, such as those described. Rather, this background is only provided to illustrate one example technology area where some embodiments described herein may be practiced.

BRIEF SUMMARY

A need therefore exists for a table that eliminates or diminishes the above-described disadvantages and problems.

An aspect of an exemplary embodiment is a table that may include two or more components such as a tabletop, a lateral structure, a frame, a leg assembly, and/or a brace member. The tabletop may include a first end, a second end opposite the first end, and a center that may be disposed substantially equidistant from the first end and the second end. The tabletop may also include a first distance and the first distance may be between the first end and the center. The tabletop may be constructed from blow-molded plastic and may be integrally formed as part of the unitary, one-piece construction during a blow-molding process. Additionally, the tabletop may include two tabletop portions. The two tabletop portions may be configured to be arranged in a storage configuration in which the two tabletop portions are substantially parallel to one another. Also, the two tabletop portions may be arranged in use configuration in which the two tabletop portions are arranged in a plane. One or both of the tabletop portions may be constructed from blow-molded plastic and may be formed as part of the unitary, one-piece construction during a blow-molding process. The frame may be attached to a lower surface of the tabletop. The frame may include a first longitudinal structure that extends along the first side of the tabletop and a second longitudinal structure that extends along the second side of the tabletop. The first longitudinal structure may be separated from the second longitudinal structure by a particular distance such as a lateral frame dimension. The leg assembly may include one or more components such as a support element, a translation mechanism, and a lock device. The support element may include an end structure and the end structure may be attached to an elongated structure. The end structure may be rotatably coupled to the frame. The support element may be rotatable relative to the frame. For example, the support element may be movable between a first position and a second position, and the support element may be substantially fixed at a position on the frame. The first position may be a stored position in which the leg assembly may be positioned adjacent to or at least proximate the lower surface of the tabletop. The second position may be a use configuration in which the leg assembly extends outwardly from the tabletop, such as substantially perpendicular to the tabletop. The end structure may be rotatably coupled to the frame at a second distance from the first end of the tabletop. Also, the end structure may be rotatably coupled to the frame at a first interface. The elongated structure may include one or more support shafts. The elongated structure may include one or more legs, and the legs may be configured to be placed on a surface to support the tabletop. The elongated structure may include two legs or two support shafts; and the second distance may be between about one-fifth and one-third of the first distance. The elongated structure may include two support shafts, which may extend from the end structure. The two support shafts may be separated by shaft support separation distance. The shaft support separation distance may be less than the lateral frame dimension such that the brace member extends in a lateral direction from the frame to one of the two support shafts. The support element may define a receiver on an inner surface. The receiver may be sized and shaped to receive a lock tab and the lock tab may extend from the lock device when the lock device is in the engaged arrangement. The translation mechanism may be retained relative to the support element and the frame. The translation mechanism may be configured to translate along a portion of the support element as the support element rotates between the first position and the second position. The translation mechanism may include one or more sleeves. The one or more sleeves may at least partially surround the legs and/or the support shafts, such as the two legs or the two support shafts of the elongated structure. The sleeve may include a leg configured to be placed on a surface to support the tabletop. The leg may define a translation volume in which the support shaft may be disposed. The sleeve may include a conduit, which may define a translation volume in which a portion of the elongated structure such as a leg may be disposed. For example, when the support element is in the first position, the translation mechanism may be a first distance from the end structure. Additionally, when the support element is in the second position, the translation mechanism may be a second distance from the end structure. The first position may be closer to the end structure than the second position. The lateral structure may extend between translation mechanisms. For instance, the lateral structure may extend between a first leg of the two legs and a second leg of the two legs, or between a first support shaft of the two support shafts and a second support shaft of the two support shafts. The lock device may be at least partially disposed in the lateral structure. The lock device may be configurable in an engaged arrangement. In the engaged arrangement, the lock device may fix the translation mechanism to the support element. The lock device may be configurable in a disengaged arrangement. In the disengagement arrangement, the translation mechanism may not be fix relative to the support element. The lock device may include a compression mechanism. The compression mechanism may be configured to withdraw one or more lock tabs and the lock tabs may extend from the lateral structure into the support element. The brace member may be rotatably attached to the frame and to the translation mechanism. The brace member may be disposed between the frame and an outer portion of the translation mechanism. When the support element is in the first position, the brace member may be positioned at an angle relative to the support element and the frame. When the support element is in the second position, the brace member may be substantially parallel to the frame and the support element. The brace member may be rotatably coupled to the frame at a second interface. The second interface may be disposed between the center of the tabletop and the first interface. The brace member may be positioned between the elongated structure and the first longitudinal structure or between the elongated structure and the second longitudinal structure.

Another aspect of an exemplary embodiment is a support assembly. The support assembly may include a frame, a support element, a translation mechanism, a lock device, a brace member, and/or a lateral structure. The frame may include a first longitudinal structure and a second longitudinal structure. The first longitudinal structure and the second longitudinal structure may be separated from the first longitudinal structure by a lateral frame dimension. The support element may be rotatably coupled to the first longitudinal structure and the second longitudinal structure. The support element may be rotatable relative to the frame between a first position and a second position. The support element may be substantially fixed at a position on the frame. The support element may include an end structure and an elongated structure may be attached to the end structure. The elongated structure may include a leg. The leg may be configured to be placed on a surface to support the frame. The elongated structure may include a support shaft. The support element may define a receiver on an inner surface. The receiver may be sized and shaped to receive a lock tab and the lock tab may extend from the lock device when the lock device is configured in the engaged arrangement. The translation mechanism may be configured to translate along a portion of the support element as the support element rotates relative to the frame. The translation mechanism may include a sleeve and the sleeve may at least partially surround a structure of the support element. The sleeve may include a leg configured to be placed on a surface to support the tabletop. The leg may define a translation volume in which the support shaft may be disposed. The sleeve may include a conduit defining a translation volume in which a portion of the elongated structure such as a leg may be disposed. For example, when the support element is in the first position, the translation mechanism may be a first distance from the end structure. When the support element is in the second position, the translation mechanism may be a second distance from the end structure. The first distance may be closer to the end structure than the second position. The lock device may be configurable in an engaged arrangement. In the engaged arrangement, the lock device may fix the translation mechanism relative to the support element. The lock device may be configurable in a disengaged arrangement. In the disengaged arrangement, the lock device may not fix the translation mechanism relative to the support element. The lock device may be biased in the engaged arrangement when the support element is in the first position. The brace member may be disposed between the frame and an outer portion of the translation mechanism. The brace member may be rotatably attached to the frame and to the translation mechanism. The lateral structure may be attached to the translation mechanism. The lock device may be at least partially disposed in the lateral structure. The lock device may include a compression mechanism. The compression mechanism may be configured to withdraw lock tabs that extend from the lateral structure into the support element.

Some benefits of exemplary embodiments, and other embodiments, may include increasing a volume below the tabletop of a table. For instance, the leg assemblies or the support assemblies may at least partially, at least substantially, or completely move one or more brace members and other components of the leg assemblies or the support assemblies outside of the volume below the tabletop. For instance, the brace members may be moved to the edges and/or the lateral element may be moved towards the lower surface of the tabletop. Accordingly, one or more components of the leg assemblies and/or the support assemblies may not interfere with the legs of the user and/or may facilitate chairs or other objects being placed below the tabletop.

A further aspect is a table that may include a tabletop, a frame attached to the tabletop, and leg assembly. The leg assembly may include a support element with an end structure attached to an elongated structure, the end structure may be rotatably coupled to the frame, and the support element may be rotatable relative to the frame between a first position and a second position. A translation mechanism may be retained relative to the support element and the frame, and the translation mechanism may be configured to translate along a portion of the support element as the support element rotates between the first position and the second position. A lock device may be configurable in an engaged arrangement in which the lock device fixes the translation mechanism to the support element and configurable in a disengaged arrangement in which the translation mechanism is not fixed relative to the support element. The table may include a brace member rotatably attached to the frame and to the translation mechanism, the brace member may be disposed between the frame and an outer portion of the translation mechanism. When the support element is in the first position, the brace member may be disposed at an angle relative to the support element and the frame. When the support element is in the second position, the brace member may be disposed at least substantially parallel to the frame and the support element. The tabletop may include a first end, a second end opposite the first end, and a center that is disposed substantially equidistant from the first end and the second end. The tabletop may have a first distance between the first end and the center, the end structure may be rotatably coupled to the frame at a second distance from the first end, and the second distance may be between about one-fifth and about one-third of the first distance. The end structure may be rotatably coupled to the frame at a first interface, the brace member may be rotatably coupled to the frame at a second interface, and the second interface may be disposed between the center and the first interface. The tabletop may include a first side and a second side opposite the first side, the frame may include a first longitudinal structure that extends along the first side and a second longitudinal structure that extends along the second side, and the brace member may be positioned between the elongated structure and the first longitudinal structure or between the elongated structure and the second longitudinal structure. The first longitudinal structure may be separated from the second longitudinal structure by a lateral frame dimension, the elongated structure may include two support shafts that extend from the end structure, the two support shafts may be separated by a shaft support separation distance, and the shaft support separation distance may be less than the lateral frame dimension such that the brace member extends in a lateral direction from the frame to one of the two support shafts. The translation mechanism may include a sleeve that at least partially surrounds the elongated structure, the elongated structure may include a support shaft, the sleeve may include a leg configured to be placed on a surface to support the tabletop, and the leg may define at least a portion of a translation volume in which the support shaft is disposed. The translation mechanism may include a sleeve that at least partially surrounds the elongated structure, the elongated structure may include a leg configured to be placed on a surface to support the tabletop, and the sleeve may include a conduit defining a translation volume in which a portion of the leg is disposed. When the support element is in the first position, the translation mechanism may be a first distance from the end structure; when the support element is in the second position, the translation mechanism is a second distance from the end structure; and the first position is closer to the end structure than the second position. A lateral structure may be attached to the translation mechanism, and the lock device being at least partially disposed in the lateral structure. A compression mechanism of the lock device may be configured to withdraw one or more lock tabs that extend from the lateral structure into the support element. The elongated structure may include two legs or two support shafts, the translation mechanism may include one or more sleeves that at least partially surrounds the two legs or the two support shafts, and the lateral structure may extend from a first leg of the two legs to a second leg of the two legs or from a first support shaft of the two support shafts to a second support shaft of the two support shafts. The support element may define at least a portion of a receiver on an inner surface and the receiver may be sized and shaped to receive a lock tab that extends from the lock device when the lock device is in the engaged arrangement.

A still further aspect is a support assembly that may include a frame with a first longitudinal structure and a second longitudinal structure, the first longitudinal structure may be separated from the second longitudinal structure by a lateral frame dimension; a support element may be rotatably coupled to the first longitudinal structure and the second longitudinal structure; a translation mechanism may be configured to translate along a portion of the support element as the support element rotates relative to the frame; a lock device may be configurable in an engaged arrangement in which the lock device fixes the translation mechanism relative to the support element and configurable in a disengaged arrangement in which the lock device does not fix the translation mechanism relative to the support element; and a brace member may be disposed between the frame and an outer portion of the translation mechanism, the brace member may be being rotatably attached to the frame and to the translation mechanism. The support element may be rotatable relative to the frame from a first position to a second position, the support element may be substantially fixed at a position on the frame, and the lock device may be biased in the engaged arrangement when the support element is in the first position. The translation mechanism may include a sleeve that at least partially surrounds a structure of the support element. The support element may include an end structure and an elongated structure that is attached to the end structure, the elongated structure may include a support shaft, the sleeve may include a leg configured to be placed on a surface, and the leg may define at least a portion of a translation volume in which the support shaft is disposed. When the support element is in the first position, the translation mechanism may be a first distance from the end structure; when the support element is in the second position, the translation mechanism may be a second distance from the end structure; and the first distance may be closer to the end structure than the second position. The support element may include an end structure and an elongated structure that is attached to the end structure, the elongated structure may include a leg configured to be placed on a surface to support the frame, and the sleeve may include a conduit defining a translation volume in which a portion of the leg is disposed. A lateral structure may be attached to the translation mechanism, the lock device may be at least partially disposed in the lateral structure, and the lock device may include a compression mechanism configured to withdraw lock tabs that extend from the lateral structure into the support element. The support element may define at least a portion of a receiver on an inner surface, and the receiver may be sized and shaped to receive a lock tab that extends from the lock device when the lock device is configured in the engaged arrangement.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of exemplary embodiments to further illustrate and clarify the above and other aspects, advantages, and features of the present invention. It will be appreciated that these drawings depict only exemplary embodiments of the invention and are not intended to limit its scope. Additionally, it will be appreciated that while the drawings may illustrate preferred sizes, scales, relationships and configurations of the invention, and the drawings may be to scale, the drawings are not intended to limit the scope of the claimed invention. The invention will be described and explained with additional specificity and detail through the use of the accompanying drawings in which:

DETAILED DESCRIPTION OF EXEMPLARY EMBODIMENTS

The present invention is generally directed towards furniture, such as tables. The principles of the present invention, however, are not limited to furniture or tables. It will be understood that, in light of the present disclosure, the exemplary tables disclosed herein can have a variety of shapes, sizes, configurations, and arrangements. In addition, while the exemplary tables shown in the accompanying figures are banquet or utility tables, it will be appreciated the tables may have any suitable style or configuration, such as round tables, personal tables, conference tables, and/or card tables. Further, the invention disclosed herein may be successfully used in connection with other types of furniture and/or structures.

Additionally, to assist in the description of the exemplary embodiments, words such as top, bottom, front, rear, right and left may be used to describe the accompanying figures which may be, but are not necessarily, drawn to scale. It will further be appreciated the tables can be disposed in a variety of desired positions or orientations, and used in numerous locations, environments, and arrangements. A detailed description of exemplary embodiments the table now follows.

Figure 1A:
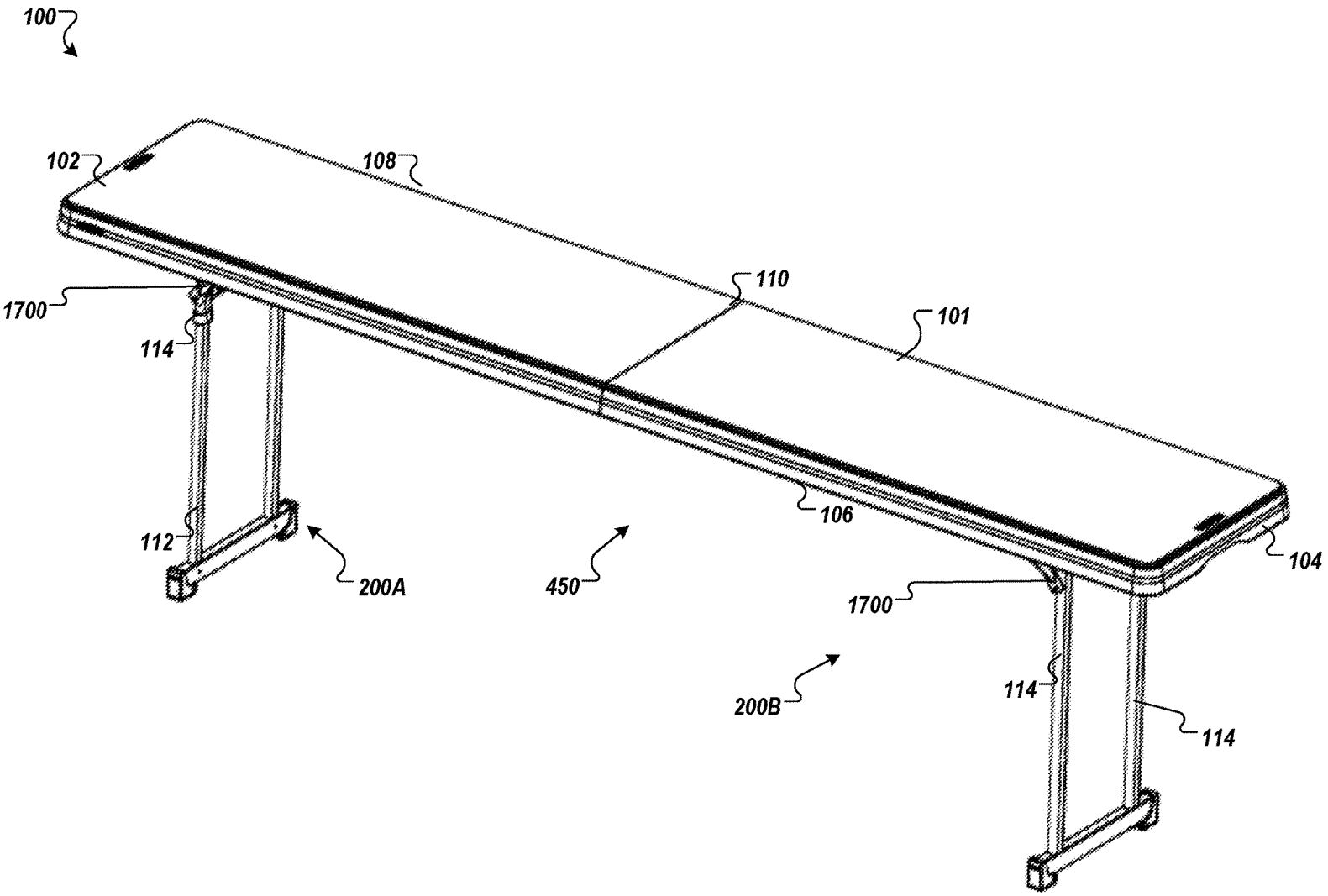
FIG. 1A is an upper perspective view of an exemplary table that may implement a first and/or a second leg assembly.
Figure 1B:
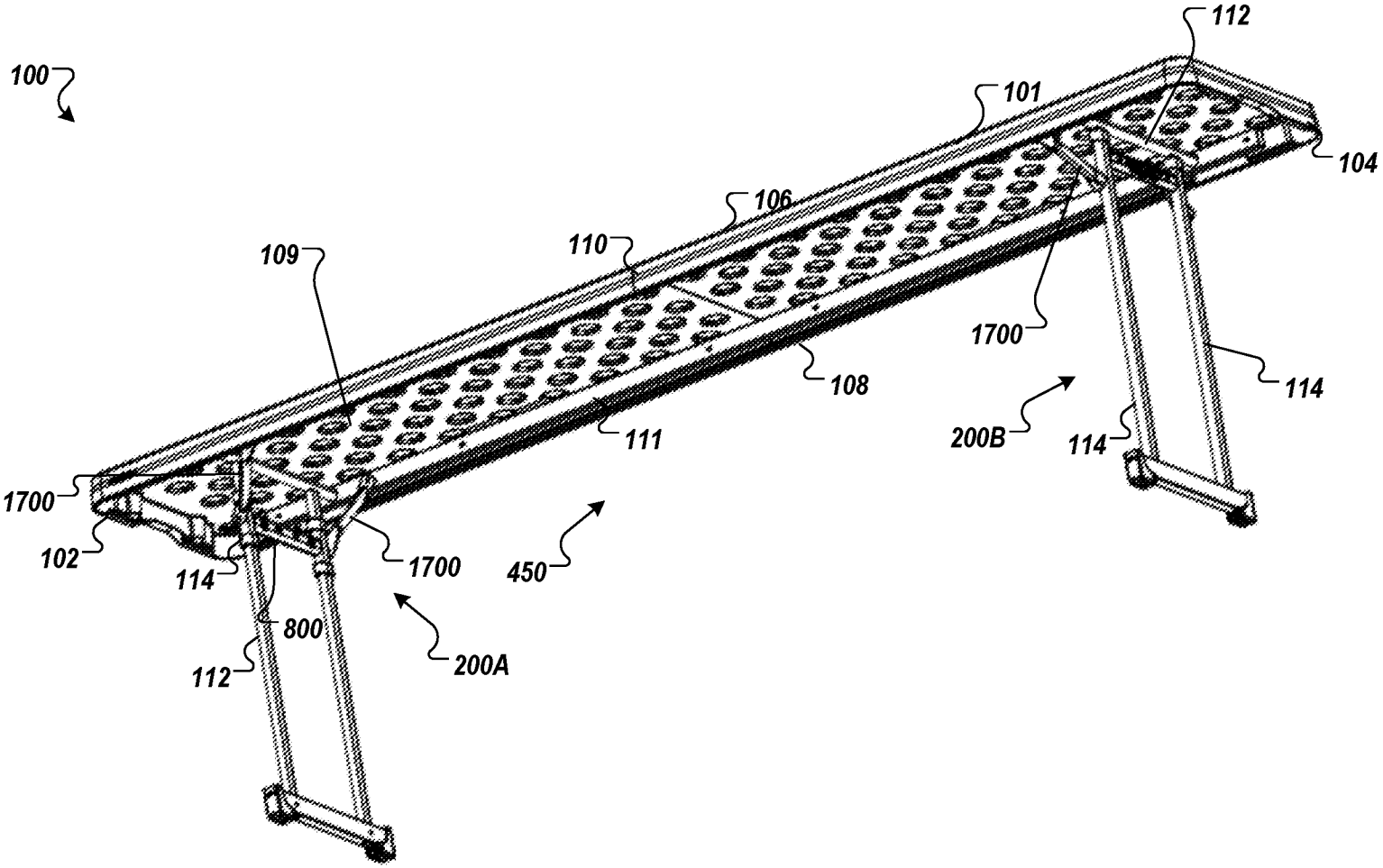
FIG. 1B is a lower perspective view of the table shown in FIG. 1A.

FIGS. 1A-1D illustrate an exemplary table 100 (which may be referred to as a first table 100 for convenience and readability) that may implement one or more leg assemblies 200A or 200B (collectively, leg assemblies or generally leg assembly 200) and one or more of the leg assemblies 200 may include one or more of the features or embodiments described in the present disclosure. FIG. 2 is an enlarged view of a portion of the first table 100 depicting the first leg assembly 200A attached to an exemplary tabletop 101. Referring to FIGS. 1A-2, the first table 100 may include the tabletop 101 and the table top may be selectively supported by a support assembly 450 relative to a surface such as the floor or the ground. The support assembly 450 may include one or more of the leg assemblies 200, which may be positioned in a first position and a second position. In the first position, the leg assemblies 200 may be disposed in a storage configuration in which the leg assemblies 200 are positioned adjacent to or at least proximate a lower surface 109 of the tabletop 101. Such positioning may reduce a height of the first table 100, which may reduce the volume used by the first table 100 when storing the first table 100. The second position may be a use configuration. In the second position, the leg assemblies 200 may extend outwardly and may be disposed substantially perpendicular to the lower surface 109 of the tabletop 101. The leg assemblies 200 may support the tabletop 101 such that the table 100 may be used. In FIGS. 1A-1D, the leg assemblies 200 are shown in the use configuration.

Figure 1C:
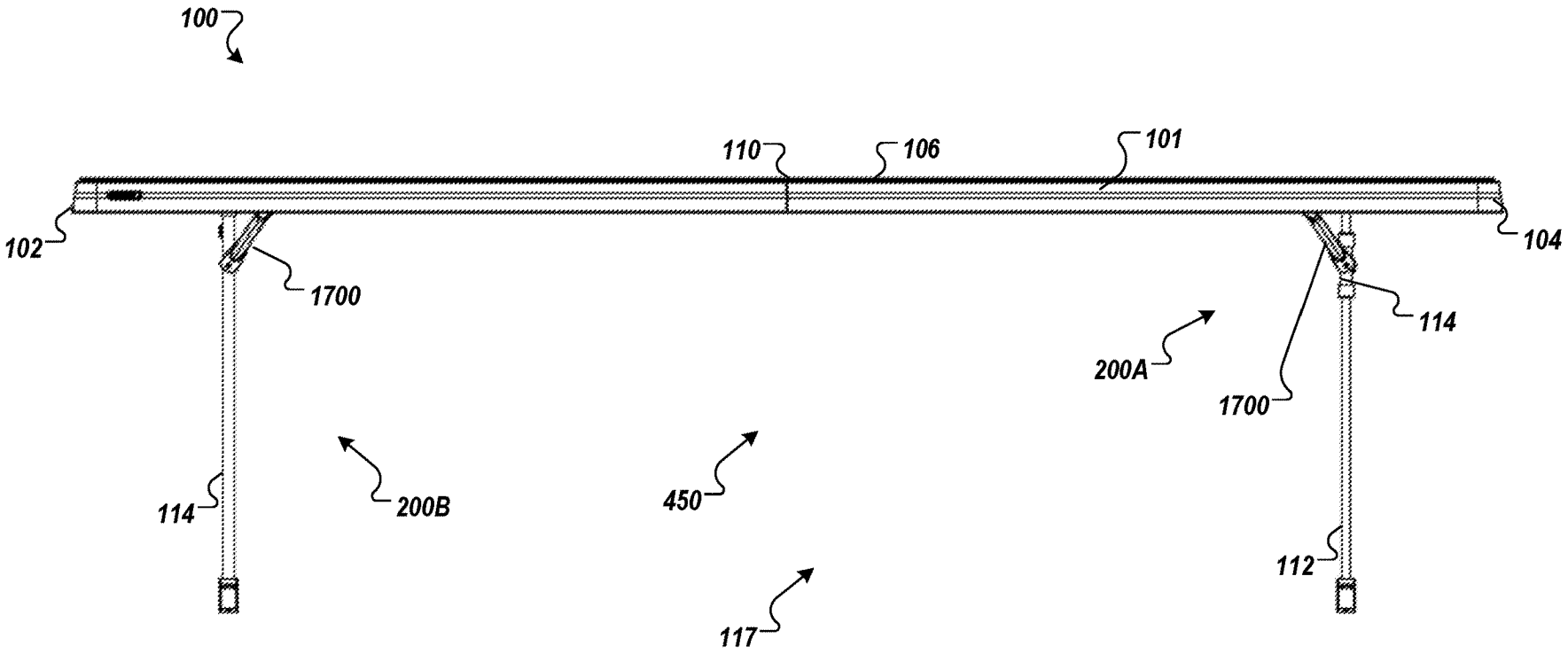
FIG. 1C is a side view of the table shown in FIG. 1A.
Figure 1D:
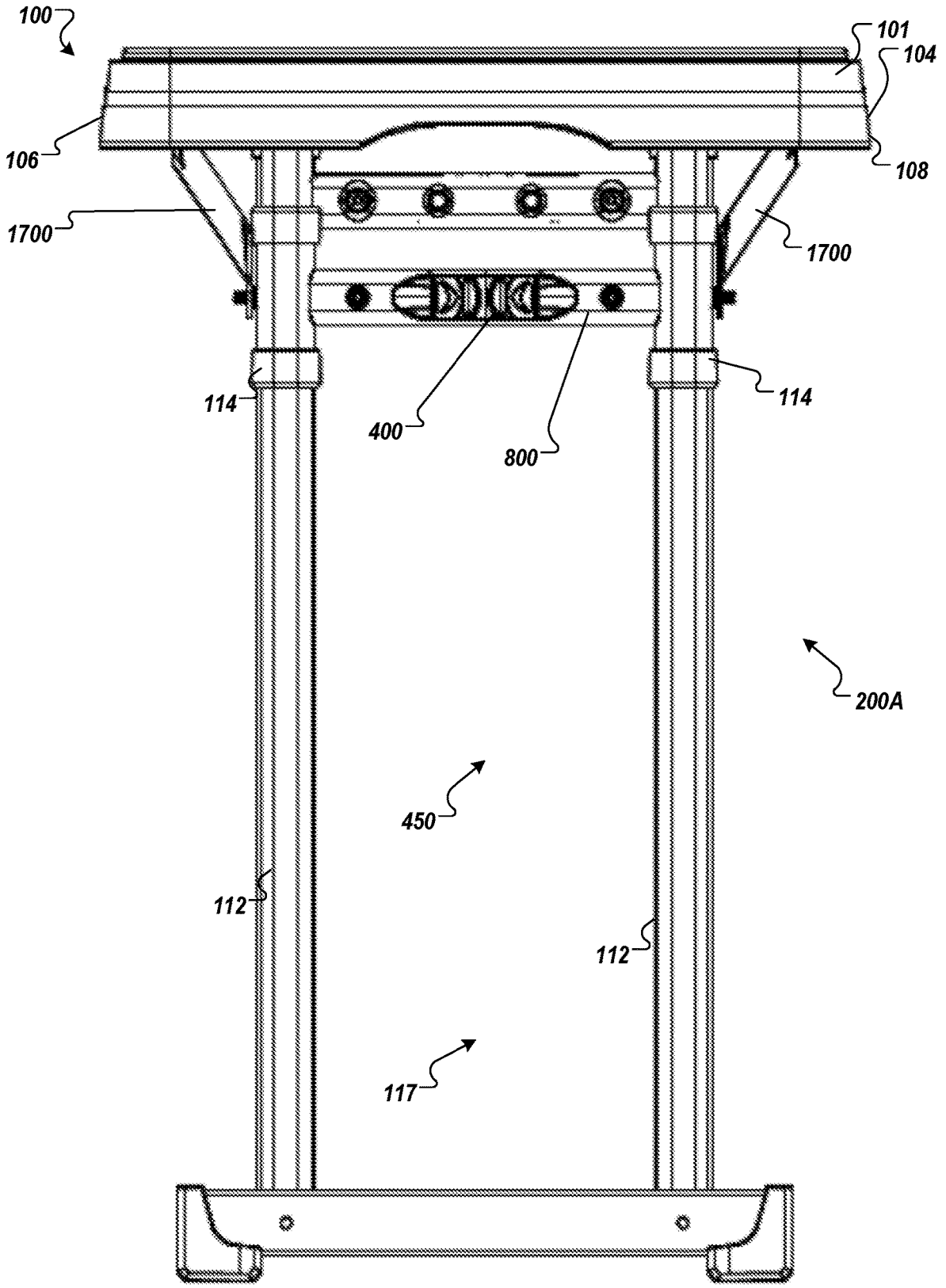
FIG. 1D is an enlarged end view of the table shown in FIG. 1A.
Figure 2:
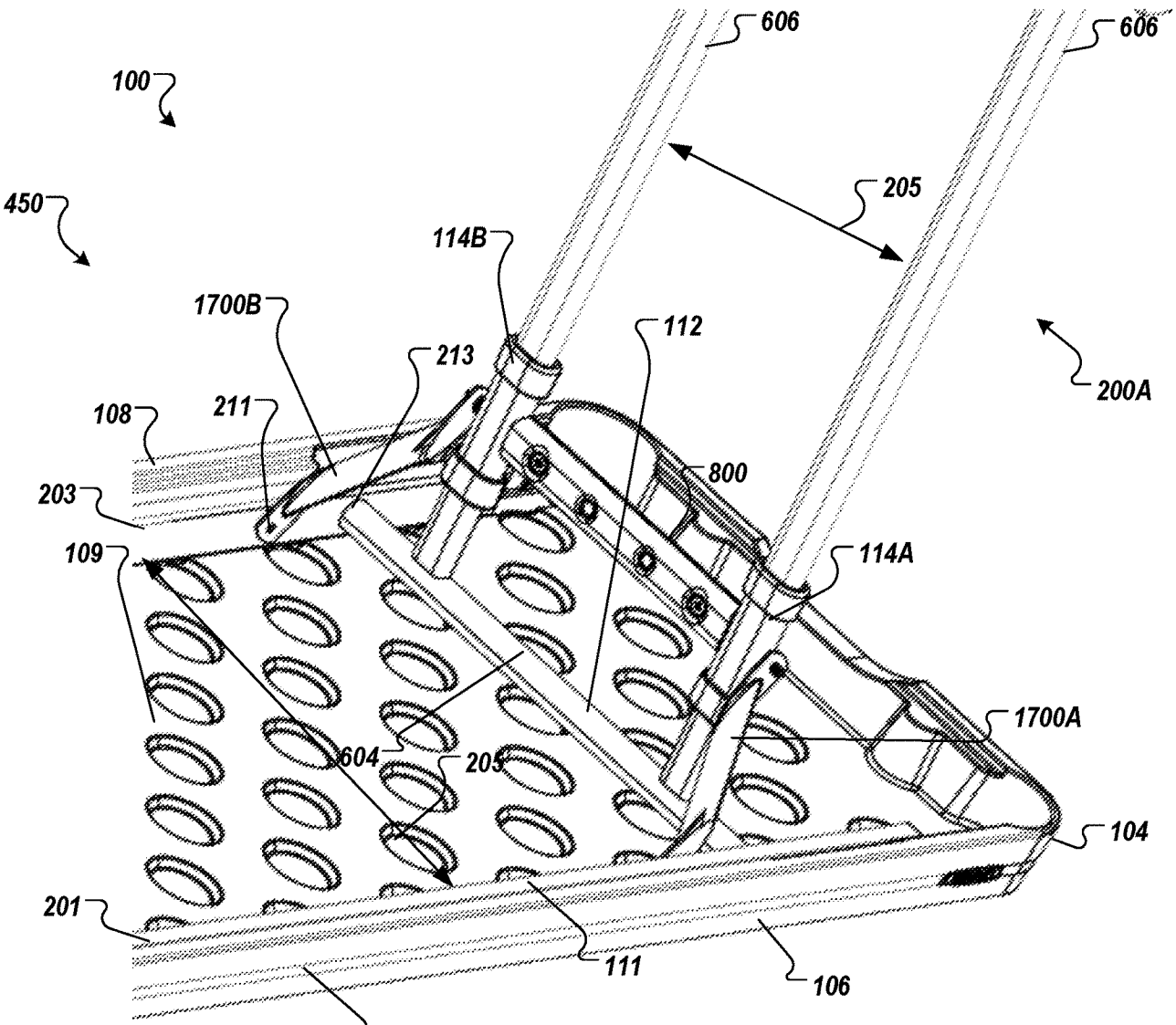
FIG. 2 is an enlarged view of a portion of the table shown in FIG. 1A, depicting an exemplary leg assembly attached to an exemplary tabletop.

Referring to FIGS. 1C and 1D, the support assembly 450 and the leg assemblies 200 may be configured to open up or increase the volume 117 below the tabletop 101. For instance, in some existing tables, the leg assemblies include angled supports. The angled supports may extend from a center of the tabletop to a cross member of the leg assemblies. Accordingly, the angled supports may occupy or be disposed in the volume (e.g., 117) below the tabletop. Presence of the angled supports may limit use of the table because the angled supports may interfere with chairs being placed around the table, limit placement of a user's legs under the table, and the like.

Accordingly, in order to overcome this and other disadvantages, exemplary embodiments of the table 100 may not have angled supports that extend from a center 110 of the tabletop 101 to the leg assemblies 200. Instead, the leg assemblies 200 may include brace members 1700. The brace members 1700 may be coupled between a frame 111 and the leg assemblies 200. The brace members 1700 may be located near or at least proximate outer edges of the tabletop 101. The locations of the brace members 1700 may open up and increase the volume 117 below the tabletop 101, which may increase the usefulness of the table 100.

The leg assemblies 200 may include a support element 112 and a translation mechanism 114. The brace members 1700 may be coupled between the translation mechanism 114 and the frame 111. As the support element 112 transitions between a first position and a second position, the brace members 1700 may rotates and the translation mechanism 114 may translate along a portion of the support element 112. In the use configuration, the leg assembly 200 may be locked, which may secure the leg assemblies 200 by prohibiting the translation mechanism 114 from translating along the support element 112.

In some embodiments, the leg assemblies 200 may include a lock device 400. The lock device 400 may be configurable in an engaged arrangement in which the lock device 400 fixes the translation mechanism 114 to the support element 112, which may lock the leg assemblies 200. Accordingly, in the engaged arrangement, the leg assemblies 200 may be fixed such that the translation mechanism 114 cannot translate relative to the support element 112. The lock device 400 may also be configurable in a disengaged arrangement in which the translation mechanism 114 may be not fixed relative to the support element 112. In the disengaged arrangement, the leg assemblies 200 may transition between the second position and the first position.

The first table 100 shown in FIGS. 1A-2 is a seminar table. The seminar table may have a length of about ninety-six inches between a first end 102 and a second end 104. The seminar table may have a width of about eighteen inches between a first side 106 and a second side 108. The tabletop 101 of the seminar table may be constructed of a blow-molded plastic such as a high-density polyethylene (HDPE). Additionally, or alternatively, the seminar table may be a unitary, one-piece structure, that may be integrally formed using a blow molding process. One of ordinary skill in the art, after reviewing this disclosure, will appreciate that the table could be constructed from other suitable materials and processes.

As shown in the accompanying figures, the leg assemblies 200 may be used in connection with the seminar table. After reviewing this disclosure, one of ordinary skill in the art will appreciate that the leg assemblies 200 may be used with other types of tables and structures. For example, the leg assemblies 200 may be implemented in other types of tables or structures, and these tables or structures may be at least partially constructed from blow-molded materials. The leg assemblies 200, however, do not have to be used in connection with tables or structures at least partially constructed from blow-molded materials. The leg assemblies 200 could be used with any appropriate tables or structures, and the table or structures could be made from any materials with suitable properties and characteristics. For instance, the leg assemblies 200 may be implemented in banquet tables (e.g., 72 inch tables, 96 inch tables, etc.), fold-in-half tables (e.g., second table 900), folding tables, nesting tables, round tables, bistro tables, fold-in-half round tables, benches, picnic tables, and the like. Thus, it will be understood that the leg assemblies 200 may be used in connection with any type of table or structure, as desired.

Referring to FIG. 1C, the first table 100 may include two type of leg assemblies 200. For instance, as best illustrated in FIG. 1B, the table 100 may include a first leg assembly 200A and a second leg assembly 200B. Both of the first and second leg assemblies 200A and 200B may include the support element 112, the translation mechanism 114, the lock device 400, and the brace members 1700. Additionally, both the first and second leg assemblies 200A and 200B may be configured to rotate between the first position and the second position relative to the tabletop 101. The first leg assembly 200A and the second leg assembly 200B are described independently below.

Figure 3A:
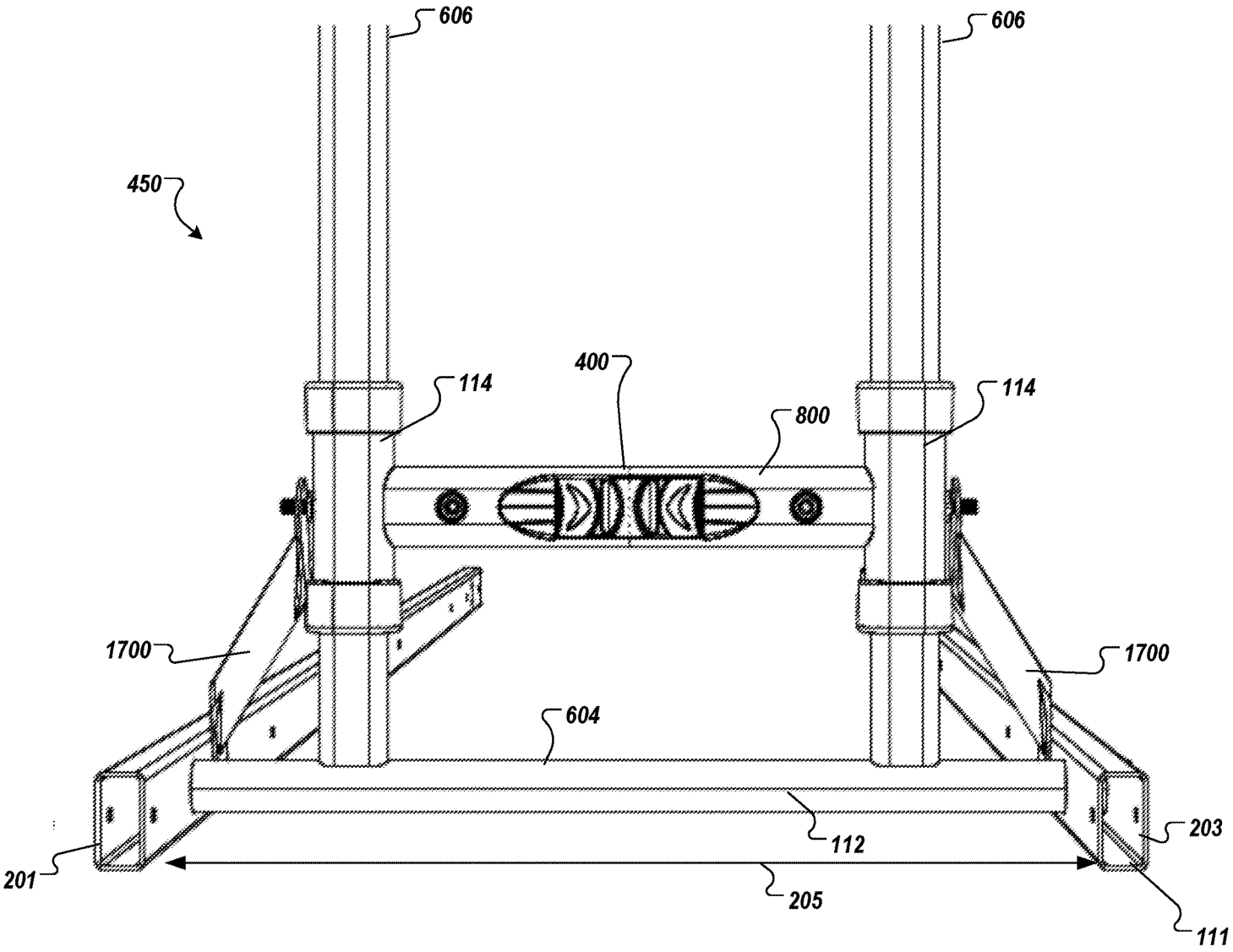
FIG. 3A is a perspective view of a portion of an exemplary support assembly.
Figure 3B:
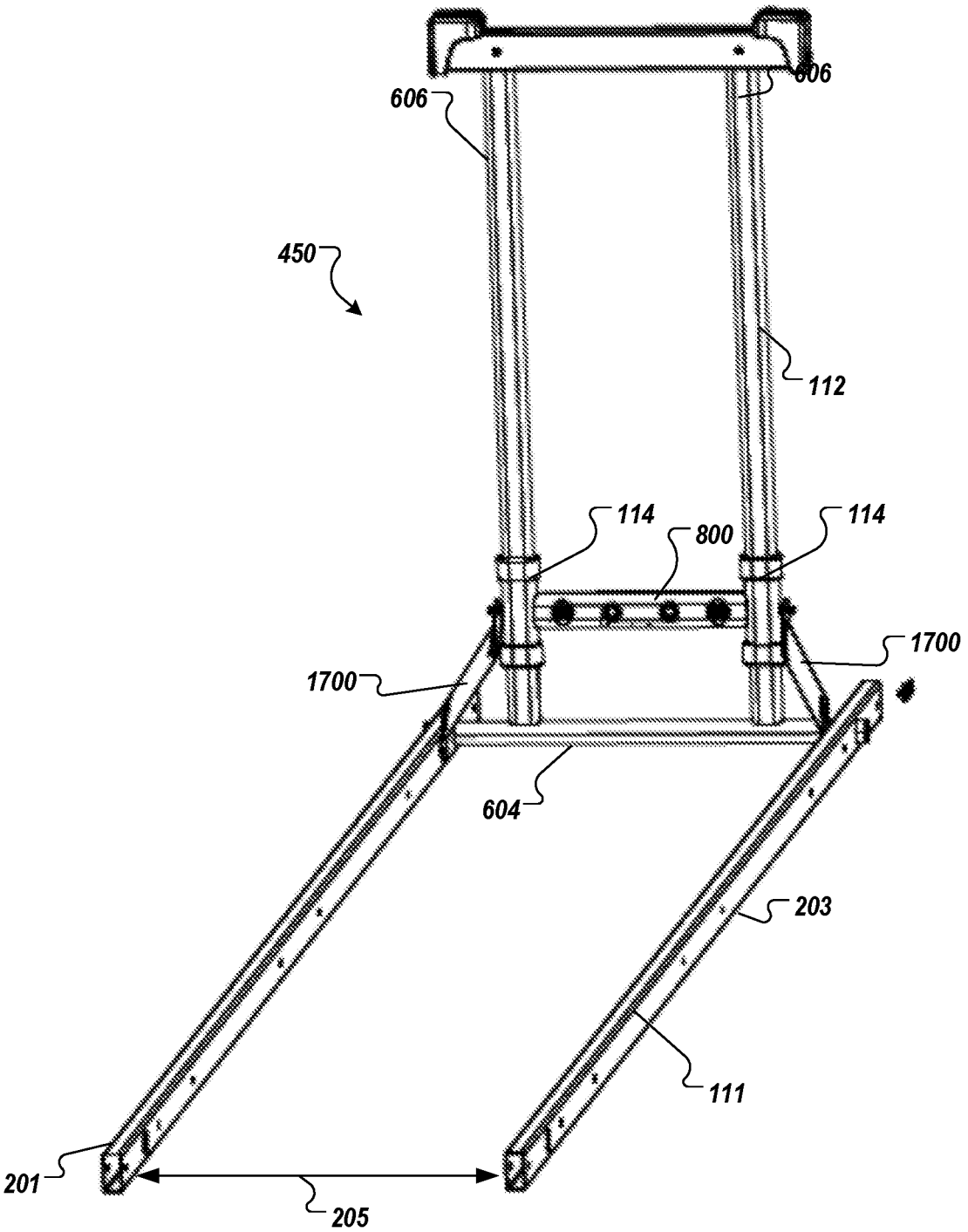
FIG. 3B is another perspective view of the support assembly shown in FIG. 3A.

FIG. 2 depicts a portion of the first table 100 shown in FIGS. 1A-1D. The first leg assembly 200A, a portion of the frame 111, and a portion of the tabletop 101 are included in the portion of the first table 100 shown in FIG. 2. Additionally, FIGS. 3A and 3B depict additional views of the support assembly 450, which includes the frame 111 and the first leg assembly 200A.

The support assembly 450 may include the frame 111, the support element 112, the translation mechanism 114, the lock device 400, the brace members 1700, and the lateral structure 800. The frame 111 may include the first longitudinal structure 201 and the second longitudinal structure 203. The first longitudinal structure 201 may be separated by a lateral frame dimension 205 from the second longitudinal structure 203. The first and second longitudinal structures 201 and 203 may be attached to the lower surface 109 of the tabletop 101. The leg assemblies 200 may be attached to the tabletop 101 indirectly via the first and second longitudinal structures 201 and 203.

The support assembly 450 may include the support element 112 and the support element may be rotatably coupled to the longitudinal structures 201 and 203. In the first leg assembly 200A, the support element 112 may include an end structure 604 and an elongated structure 606. The end structure 604 may be rotatably coupled to the frame 111. For instance, in the embodiment shown in FIGS. 2-3B, the end structure 604 may include a cylindrical rod. The cylindrical rod may be retained in the longitudinal structures 201 and 203 and the cylindrical rod may rotate relative to the frame 111.

The translation mechanism 114 may be configured to translate along a portion of the support element 112. For example, as the support element 112 rotates relative to the frame 111, the translation mechanism 114 may translate up or down the support element 112. When the support element 112 has rotated to the first position (in which the first leg assembly 200A may be perpendicular to the lower surface 109) the translation mechanism 114 may be fixed relative to the support element 112 by the lock device 400.

The leg assembly 200A may be positioned within the first and second longitudinal structures 201 and 203. For instance, with reference to FIG. 2, a first brace member 1700A may be rotatably coupled to the first longitudinal structure 201 at a first end and to a first translational mechanism 114A at a second end. The first translational mechanism 114A may be retained relative to the support element 112, which may be rotatably coupled to the frame 111. The first translational mechanism 114A may be coupled to a second translational mechanism 114B by the lateral structure 800. The second translational mechanism 114B may also be retained relative to the support element 112. The second translational mechanism 114B may be coupled to a second brace member 1700B at a first end. At a second end of the second brace member 1700B, the brace member 1700B may be rotatably coupled to the second longitudinal structure 203. Accordingly, the first leg assembly 200A and the brace members 1700 may be located between the first and second longitudinal structures 201 and 203.

With further reference to FIG. 2, the end structure 604 may be rotatably coupled to the frame at a first interface 211. Additionally, the brace member 1700 may be rotatably coupled to the frame 111 at a second interface 213. The second interface 213 may be disposed between the second end 104 and the first interface 211.

The support assembly 450 shown in FIGS. 2-3B may be implemented in other tables (e.g., banquet tables, round tables, etc.), other structures (e.g., benches, etc.), and the like. Some additional details of these structures may be in accordance with U.S. Pat. Nos. 8,397,652; 8,347,795; 8,408,146; and 8,622,007; and U.S. Patent Publication No. 2019-0298054, the disclosures of these patents and patent applications are incorporated by reference in their entireties. One of ordinary skill in the art, after reviewing this disclosure, will appreciate that some adaptations of the table 100, the frame 111, the support assembly 450, etc. may be desired or needed depending, for example, upon the type of table or structure. For instance, the frame 111 may need to be modified to use the support assembly 450 with the table 100 or other tables, structures, and the like. The leg assemblies 200A, however, in an exemplary embodiment, may operate substantially as described with reference to FIGS. 2-3B.

Figure 4A:
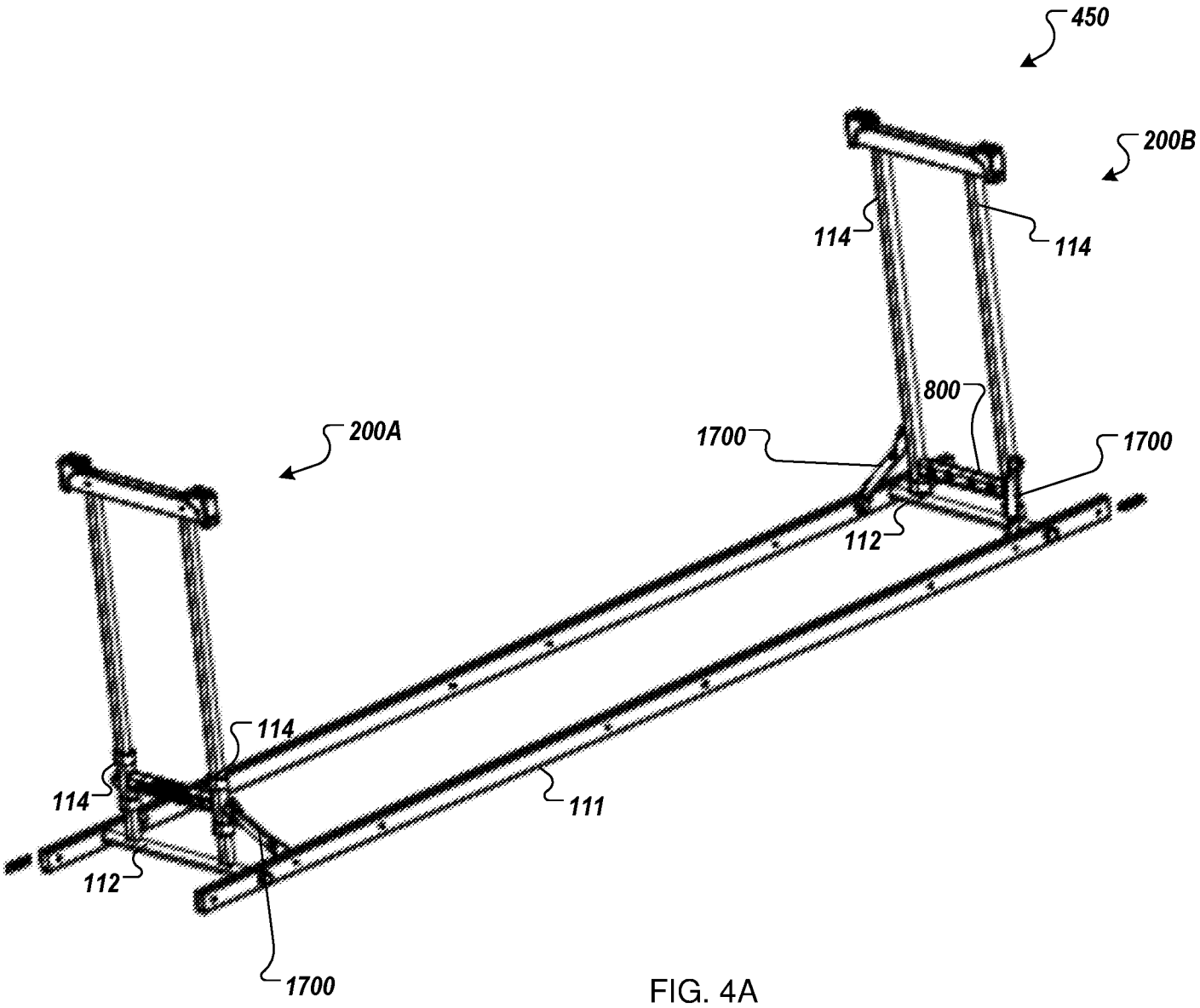
FIG. 4A is a perspective view of an exemplary support assembly, illustrating exemplary leg assemblies in a use arrangement.
Figure 4B:
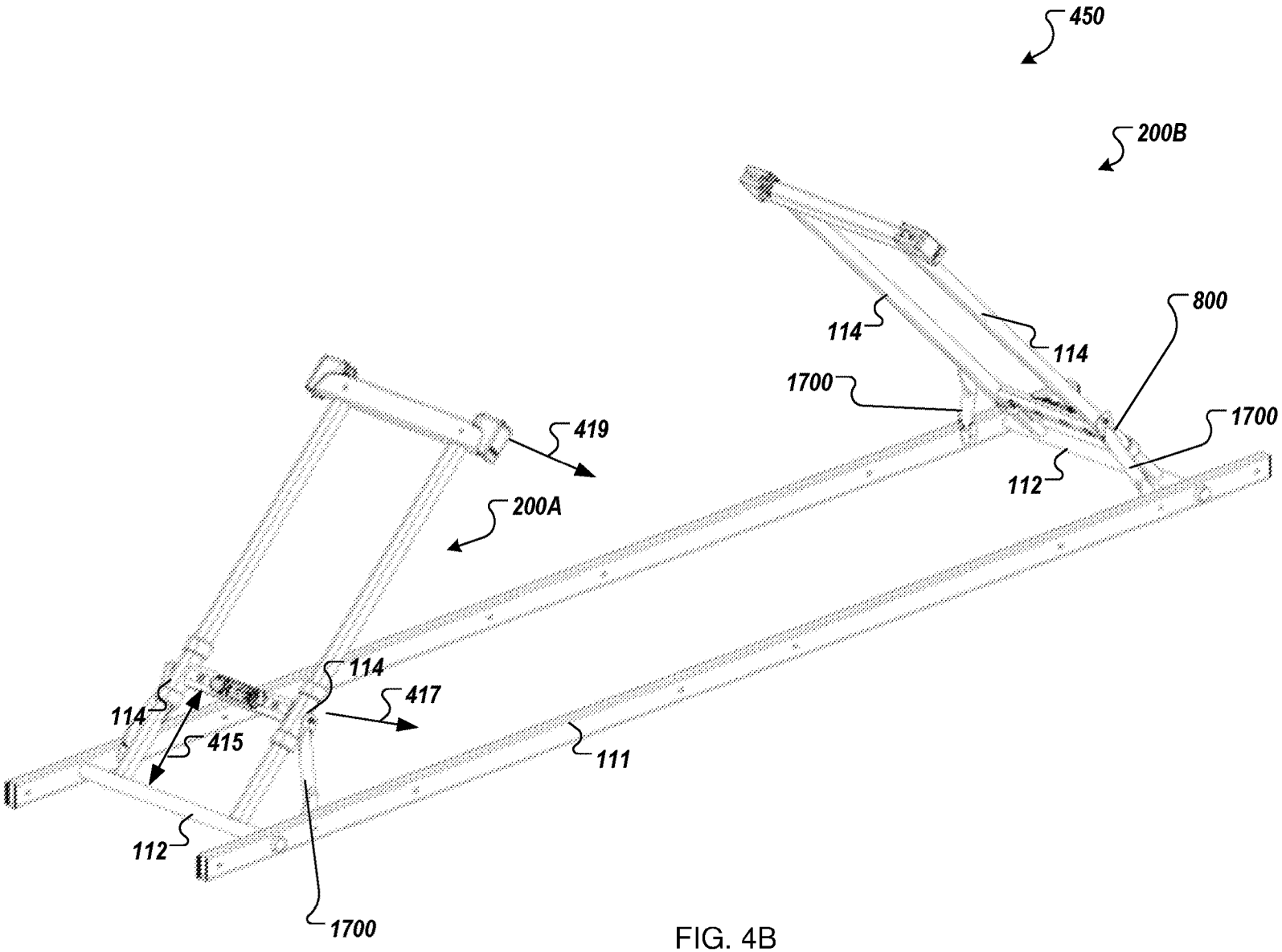
FIG. 4B is another perspective view of the support assembly shown in FIG. 4A, illustrating the leg assemblies in a partially folded arrangement.
Figure 4C:
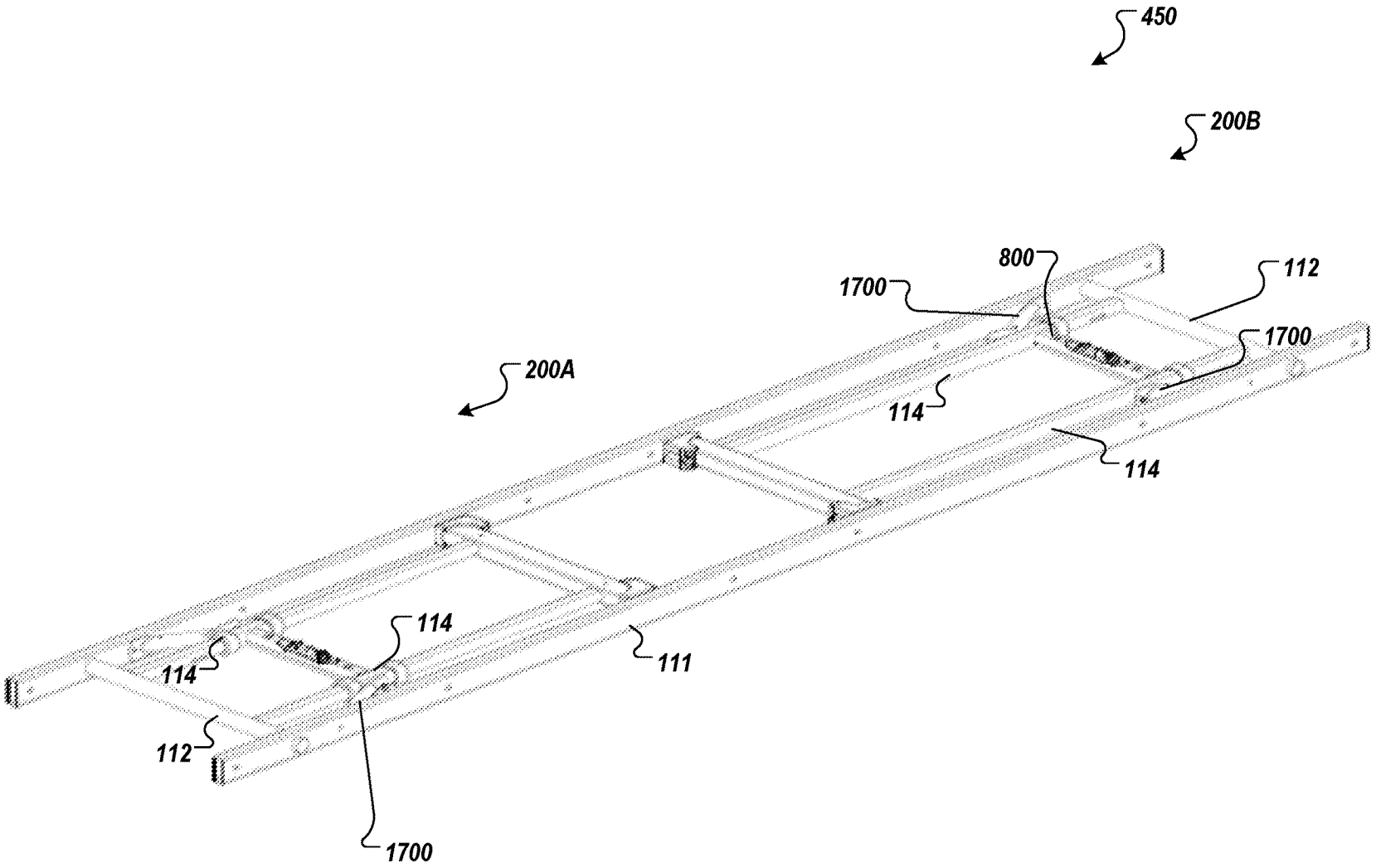
FIG. 4C is another perspective view of the support assembly shown in FIG. 4A, illustrating the leg assemblies in a storage arrangement.

FIGS. 4A-4C illustrate an exemplary embodiment of the support assembly 450 that may be implemented in the first table 100 shown in FIGS. 1A-1D, the second table 900 shown in FIGS. 9A-9D (described below), or other suitable tables or structures. FIG. 4A illustrates the support assembly 450 with the leg assemblies 200 configured in a use arrangement. FIG. 4B illustrates the support assembly 450 shown in FIG. 4A with the leg assemblies 200 partially folded. FIG. 4C illustrates the support assembly 450 shown in FIG. 4A with the leg assemblies 200 configured in a storage arrangement. Thus, the leg assemblies 200 may move between the use and storage arrangements.

With reference to FIGS. 4A-4C, the leg assemblies 200 may be configured to rotate relative to the frame 111. For instance, the leg assemblies 200 may rotate from a first angular position in which the leg assemblies 200 are disposed at least substantially perpendicular to the frame 111 (as shown in FIG. 4A) to a second angular position in which the leg assemblies 200 are at least substantially parallel to the frame 111 (as shown in FIG. 4C). FIG. 4B depicts the leg assemblies 200 transitioning from the first angular position to the second angular position.

Referring to FIG. 4A, the leg assemblies 200 are disposed in a use configuration. In the use configuration, the leg assemblies 200 may be disposed at least substantially perpendicular to the frame 111. The translation mechanisms 114 may be positioned on a surface to support the frame 111 above the surface. In the use configuration, the lock device 400 may be in an engaged arrangement. In the engaged arrangement, the lock device 400 may fix the translation mechanism 114 relative to the support element 112. Also, in the use configuration, the translation mechanism 114 may be translated towards the support element 112 and the brace members 1700 may be oriented at an angle relative to the translation mechanism 114.

Referring to FIG. 4B, to transition the first leg assemblies 200A, the lock device 400 may be transitioned from the engaged arrangement to a disengaged arrangement. When the lock device 400 is in the disengaged arrangement, the translational mechanism 114 may not be fixed to the support element 112. Accordingly, the translational mechanism 114 may translate relative to the support element 112 as the support element 112 rotates relative to the frame 111.

Additionally, the brace members 1700 may rotate with the translational mechanism 114 as the support element 112 rotates.

In particular, with reference to FIG. 4B, the first leg assembly 200A on the left of the figure may rotate in a direction represented by arrow 419. As the second leg assembly 200B rotates in the direction 419, the brace member 1700 may rotate in the same direction, which is represented by arrow 1117. Moreover, as the second leg assembly 200B rotates, a distance 415 between the lateral structure 800 and the support element 112 may increase.

Referring to FIG. 4C, the support assembly 450 is depicted in a storage configuration. In the storage configuration, the leg assemblies 200A may be disposed at least substantially parallel to the frame 111. The translation mechanisms 114 may be positioned in a volume defined by the frame 111. In the storage configuration, the lock device 400 may also be in the disengaged arrangement, which may allow the translational mechanism 114 to translate relative to the support element 112. Also, in the storage configuration, the brace members 1700 may be positioned between the translational mechanism 114 and an inner surface of the frame 111.

Figure 5A:
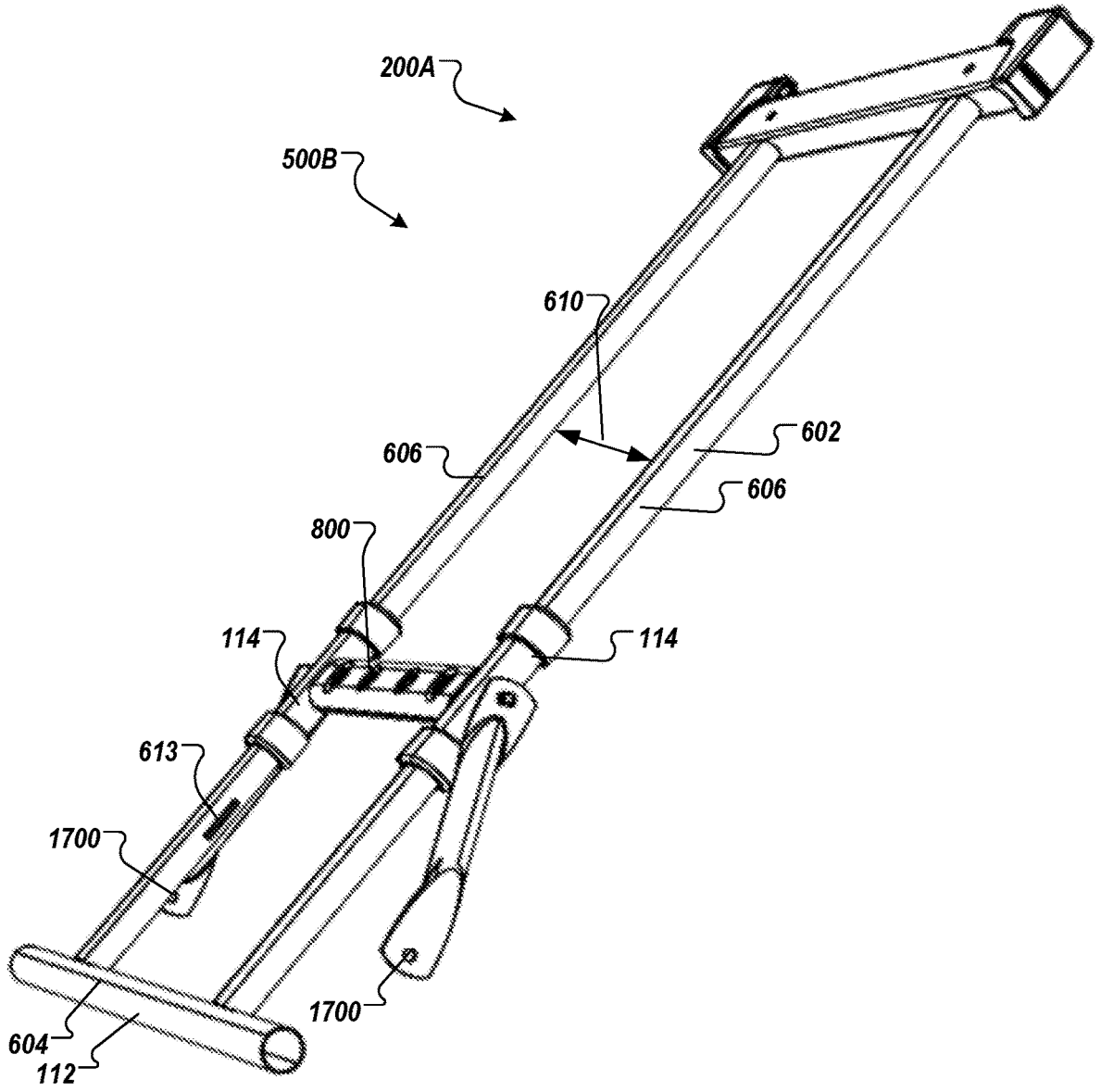
FIG. 5A is a perspective view of an exemplary leg assembly and an exemplary brace member, illustrating the leg assembly and brace member in partially folded positions.
Figure 5B:
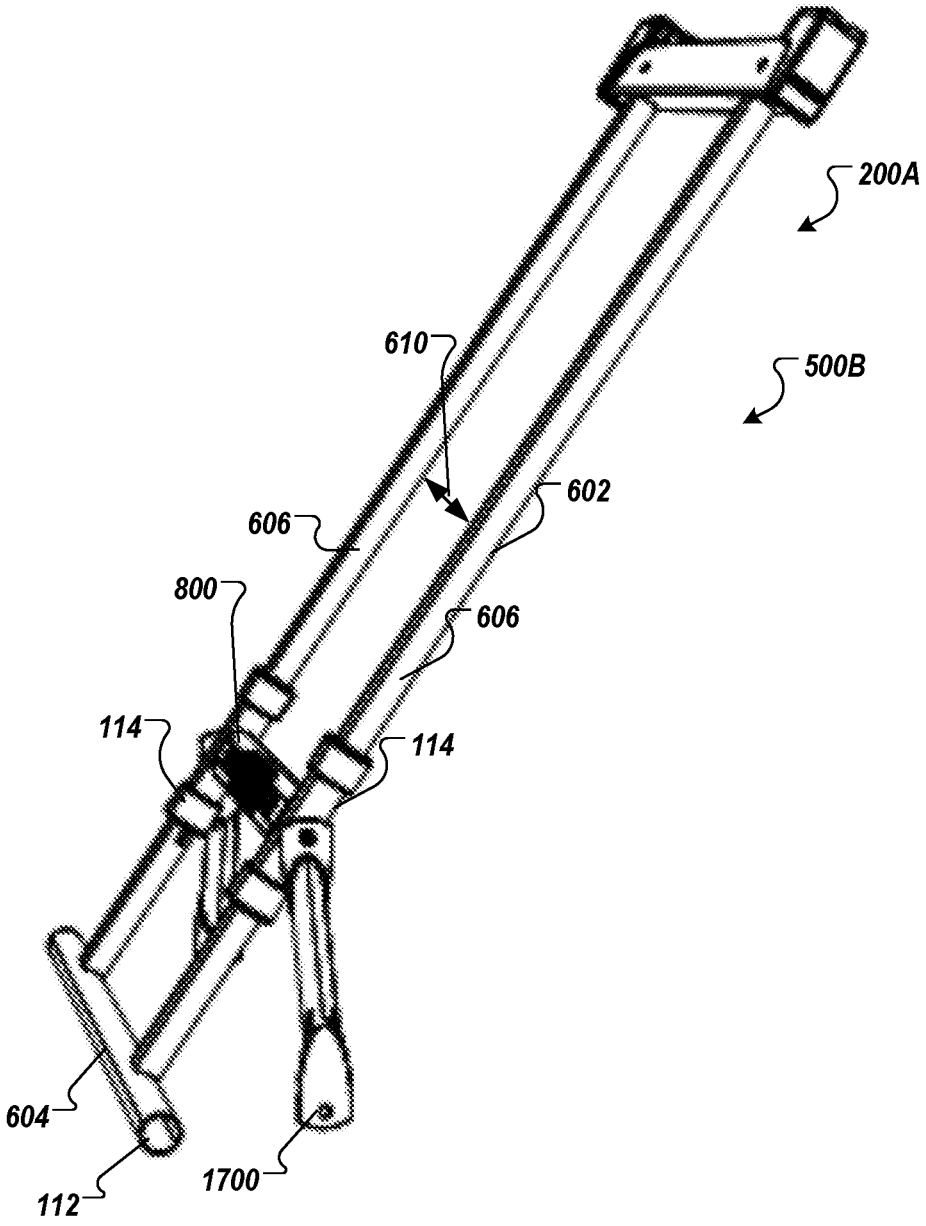
FIG. 5B is another perspective view of the leg assembly and brace member shown in FIG. 5A, illustrating the leg assembly and brace member in partially folded positions
Figure 6:
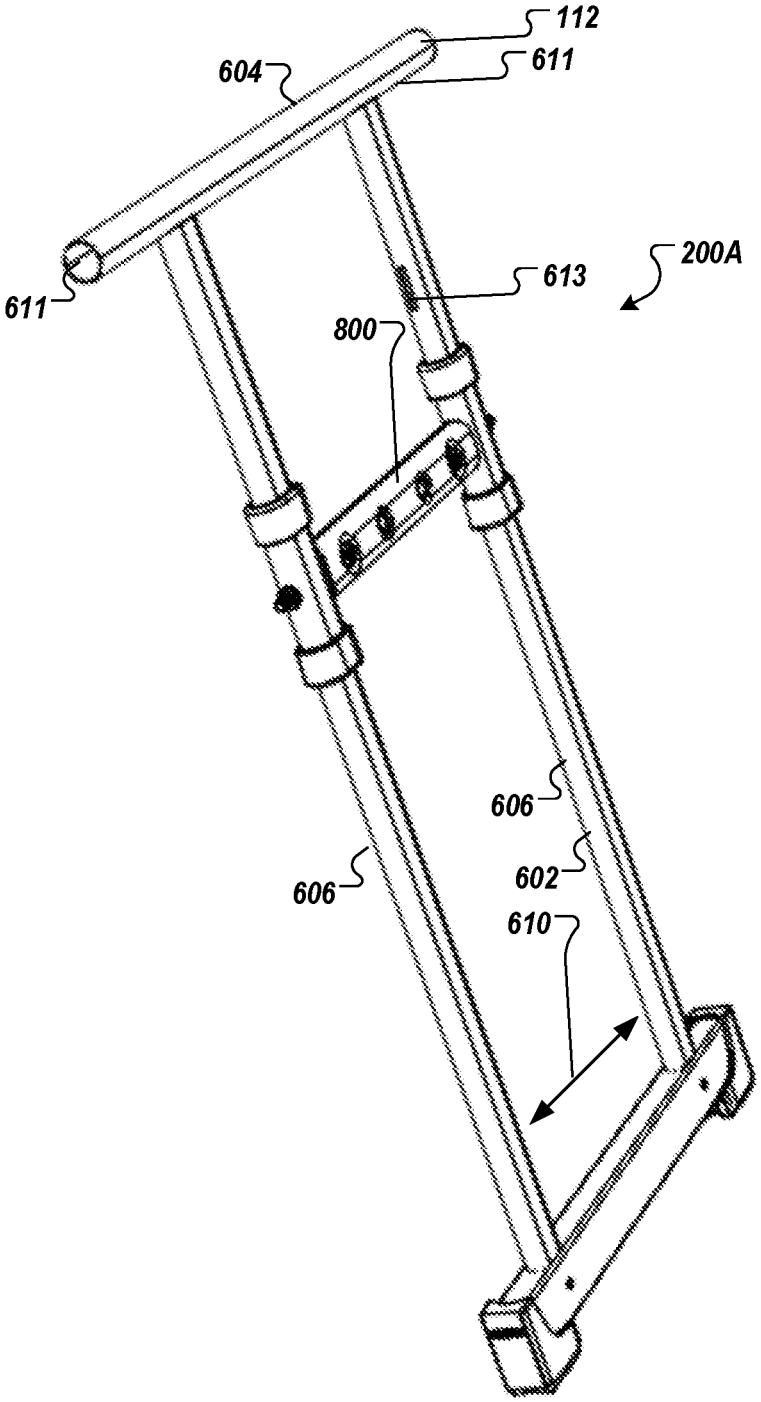
FIG. 6 is a perspective view an exemplary embodiment of a leg assembly.
Figure 7A:
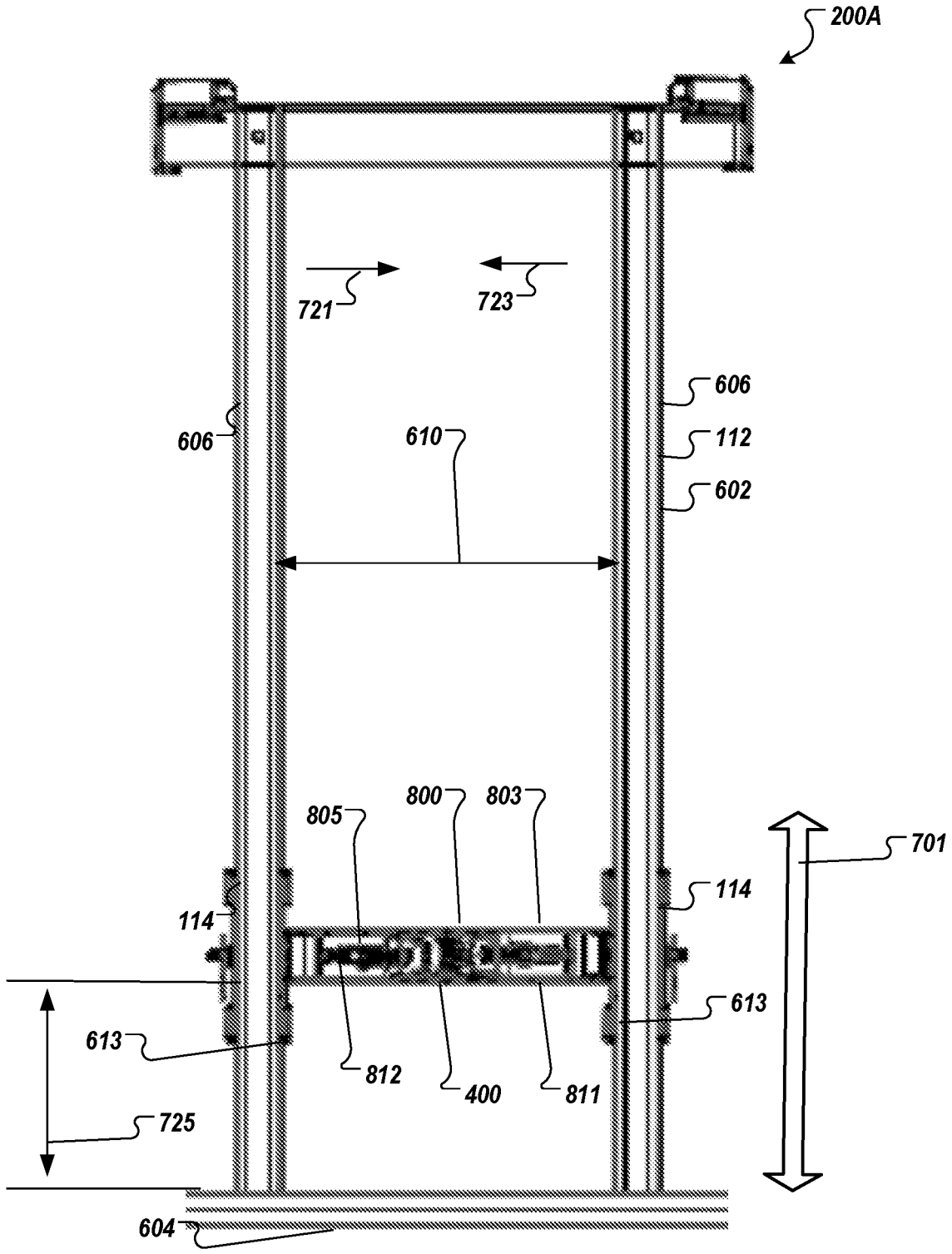
FIG. 7A illustrates an exemplary leg assembly and an exemplary translation mechanism, illustrating the translation mechanism translating on the support element.
Figure 7B:
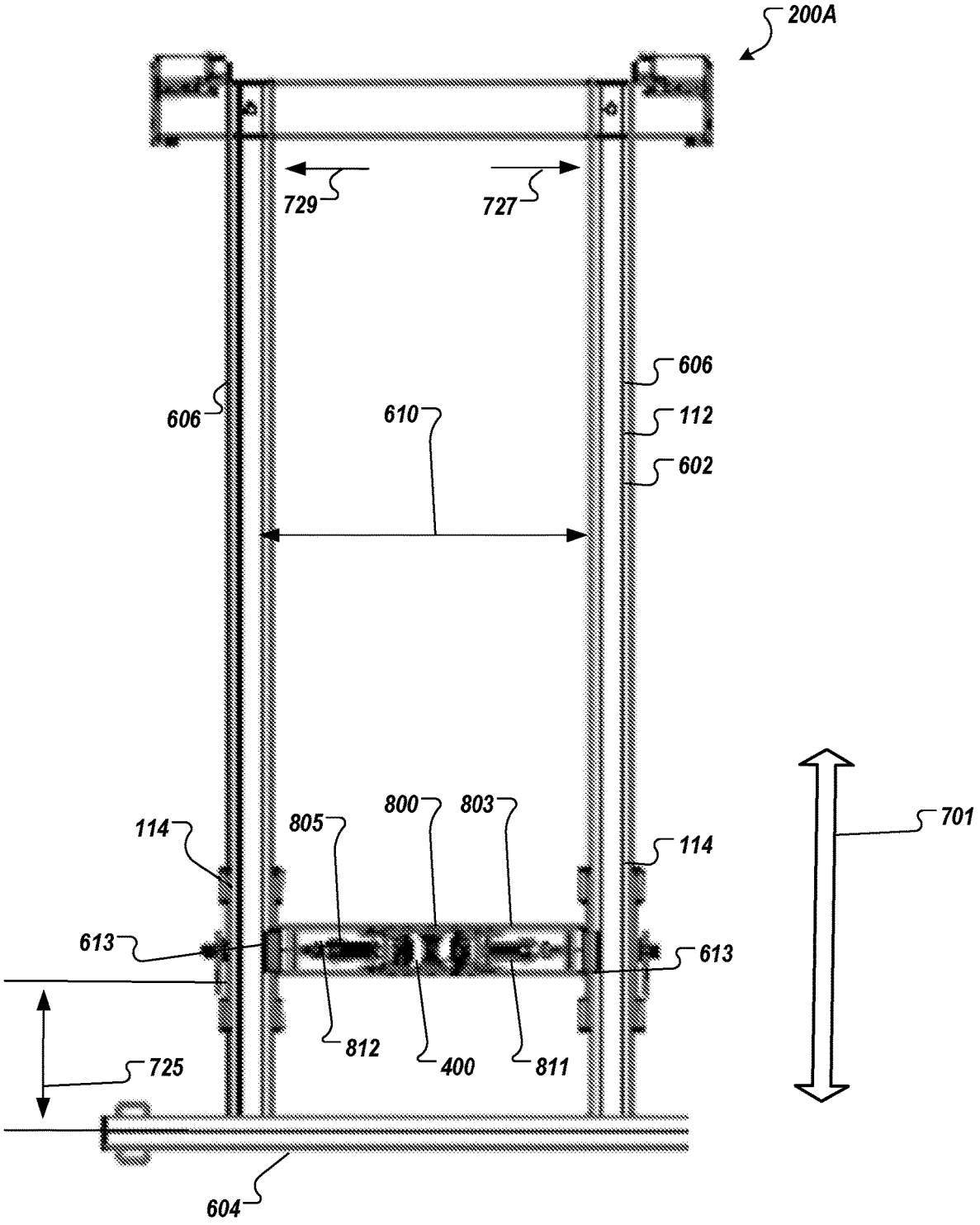
FIG. 7B illustrates an exemplary leg assembly and an exemplary translation mechanism, illustrating the translation mechanism translating on the support element.

The first leg assembly 200A and the brace members 1700 may function together to enable a transition between the use configuration and the storage configuration, such as described above. FIGS. 5A and 5B depict the first leg assembly 200A with the brace member 1700 in partially folded positions 500A and 500B. FIG. 6 illustrates a perspective view of an exemplary embodiment of the first leg assembly 200A. FIGS. 7A and 7B illustrate sectional views of the first leg assembly 200A with the translation mechanism 114 translating on the support element 112.

With reference to FIGS. 5A-7B, the first leg assembly 200A may include the support element 112, the translation mechanism 114, the lock device 400, and a lateral structure 800. Referring to FIGS. 5A-6, an exemplary support element 602 is shown and the support element 602 may be implemented in the first leg assembly 200A. The support element 602 may be an example of the support element 112 described above. Accordingly, the support element 602 may be configured to be rotatably attached to a first longitudinal structure and a second longitudinal structure of a frame (e.g., the frame 111 described above).

The support element 602 may include an end structure 604 and the end structure may be attached to one or more elongated structures 606, and the elongated structures are referred to in the embodiment shown in FIGS. 5A-6 as legs. The legs 606 may extend at least substantially perpendicular to the end structure 604. The legs 606 may each be configured to be received within a translation volume of a conduit (e.g., the conduit 802). For instance, the legs 606 may include a diameter and a length that enables the legs 606 to be received in the translation volume and for a corresponding translation mechanism to translate relative to the support element 602.

The two legs 606 may be separated by a shaft support separation distance 610. The shaft support separation distance 610 may be less than a lateral frame dimension (e.g., 205) between the first the second longitudinal structures of a frame. Thus, the legs 606 may be positioned within the fame of a table (e.g., table 100 or table 900).

The end structure 604 may be rotatably coupled to the frame. For example, the outer portions 611 (such as shown in FIG. 6) may be received by the first and the second longitudinal structures of the frame such that the support element 602 may be rotatable relative to the frame from the first position to the second position. The end structure 604 may be rotatable relative to the frame, but the end structure may be fixed relative to the frame such that the end structure 604 cannot be displaced.

The elongated structures 604 may each at least partially define a receiver, such as the receiver 613 shown in FIGS. 5A and 6. The receiver 613 may be positioned on an inner surface of the elongated structures 606 and, in this exemplary embodiment, the receivers 613 may face one another. The receiver 613 may be sized and shaped to receive a lock tab that extends from the lock device (e.g., the lock device 400) when the lock device is configured in the engaged arrangement. The size and position of the receivers 613 may correspond to openings included on conduit (e.g., the conduit 802). Accordingly, the lock tab may extend through the opening into the receiver 613.

Referring to FIGS. 5A-7B, the first leg assembly 200A may include one or more translation mechanisms 114, conduits 802, and the like. For example, the first leg assembly 200A may include two translation mechanisms 114 and/or two conduits 802. Some additional details of the conduits are provided below. The elongated structure 606 may extend into the translation mechanism 114, which may be configured to translate along a portion of the support element 112 as the support element 112 rotates relative to the frame.

The translation mechanism 114 may be retained relative to the support element 112. For instance, the translation mechanism 114 may be slidably retained relative to the support element 112 such that the translation mechanism 114 translates relative to the support element 112 in a particular direction. In the embodiment shown in FIGS. 7A and 7B, the translation mechanism 114 may translate in a direction indicated by arrows 701. Because the brace members 1700 may be rotatably coupled between the translation mechanism 114 and the frame, in order for the support element 112 to rotate, the translation mechanism 114 may translate. Accordingly, fixing the translation mechanism 114 relative to the support element 112 may prevent the support element 112 from transitioning between the use position and the storage position.

The lateral structure 800 may be attached to the translation mechanism 114. For example, in the depicted embodiment, the lateral structure 800 may extend between the translation mechanisms 114. The lock device 400 may be at least partially disposed in the lateral structure 800. The lock device 400 may include a compression mechanism 820. The compression mechanism 820 may include two opposed buttons. A user may actuate the compression mechanism 820 by drawing or pushing the two opposed buttons towards one another. Pressing the opposed buttons of the compression mechanism 820 towards one another may pull lock tabs 803 and 805 towards a center portion of the leg assembly 200B. With sufficient force, the lock tabs 803 and 805 may be withdrawn from the receivers 613 defined in the support element 112. When the lock tabs 803 and 805 are withdrawn from the receivers 613 and into the lateral structure 800, the translation mechanism 114 may translate relative to the support element 112.

The lock device 400 may be configurable in two arrangements. In an engaged arrangement, which is shown in FIG. 7B, the lock tabs 803 and 805 may extend from the sides of the lateral structure 800 and may be received in the receiver 613. In the engaged arrangement, the lock device 400 may fix the translation mechanism 114 relative to the support element 112. Accordingly, in the engaged arrangement, the translation mechanism 114 may not translate relative to the support element 112, which may prevent the support element 112 from rotating.

With reference to FIG. 7B, the lock tabs 803 and 805 are depicted engaged in the receiver 613, which corresponds to the engaged arrangement of the lock device 400. The lock tabs 803 and 805 may be biased by one or more biasing members, such as springs 812 and 811. For instance, in the depicted exemplary embodiment, the lock tabs 803 and 805 may be biased away from one another such that the lock tabs 803 and 805 are biased towards being introduced and retained in the receivers 613.

Referring back to FIGS. 5A-7B, the lock device 400 may also be configurable in a disengaged arrangement, which is depicted in FIGS. 5A, 5B, 6, and 7A. In the disengaged arrangement, the lock tabs 803 and 805 may be withdrawn from the receivers 613 and into the lateral structure 800. The translation mechanism 114 may accordingly translate relative to the support element 112, which may enable the support element 112 to rotate relative to a frame. To transition the lock device 400 from the engaged arrangement to the disengaged arrangement, a user may press one or more of the buttons on the compression mechanism 820 towards one another. The buttons may translate these forces to the lock tabs 803 and 805, and may retract the lock tabs 803 and 805 from the receivers 613.

Referring to FIGS. 7A and 7B, the first leg assembly 200A is depicted in the disengaged arrangement and the engaged arrangement, respectively. Referring to FIG. 7A, the lock tabs 803 and 805 are pulled or disposed towards one another. The direction the lock tabs 803 and 805 may be moved are represented in FIG. 7A by arrows 721 and 723. The force applied to the buttons may be sufficient to overcome a biasing force, such as a spring force applied by springs 812 and 811. With the lock tabs 803 and 805 withdrawn from the receivers 613, the translation mechanism 114 may translate relative to the support element 112. For instance, a distance 725 between the end structure 604 and a top of the lateral structure 800 may increase.

In FIG. 7B, the lock tabs 803 and 805 are pressed or disposed away from one another by the biasing member, such as the springs 812 and 811. When the lock tabs 803 and 805 are aligned with the receivers 613, the lock tabs 803 and 805 may extend into and be at least partially disposed in the receivers 613. The directions the lock tabs 803 and 805 may move because of the biasing member, such as the springs 812 and 811, are represented in FIG. 7B by arrows 727 and 729. With the lock tabs 803 and 805 positioned or at least partially disposed in the receivers 613, the translation mechanism 114 may be fixed to the support element 112, which may fix a distance 731 between the end structure 604 and a top of the lateral structure 800.

Figure 8A:
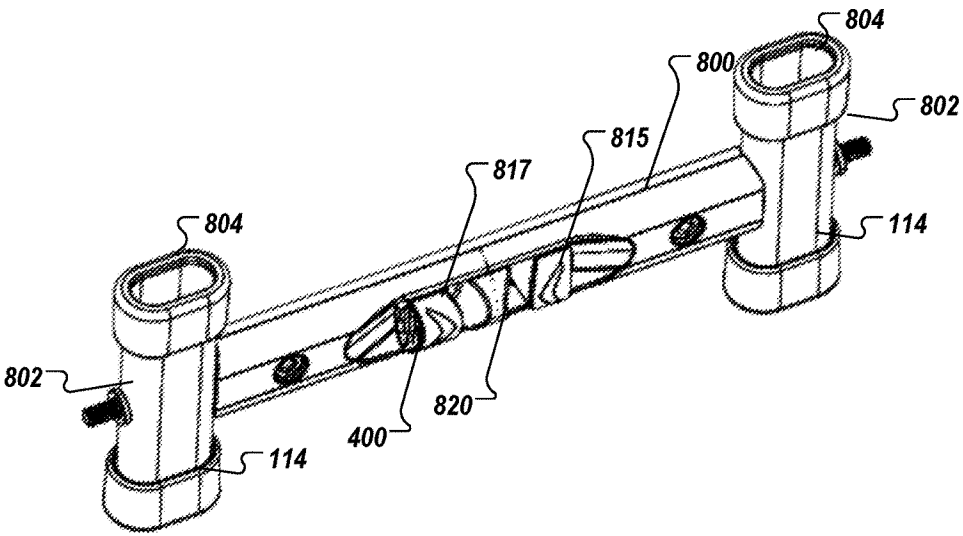
FIGS. 8A-8C illustrate an exemplary translation mechanism and an exemplary lateral structure.
Figure 8B:
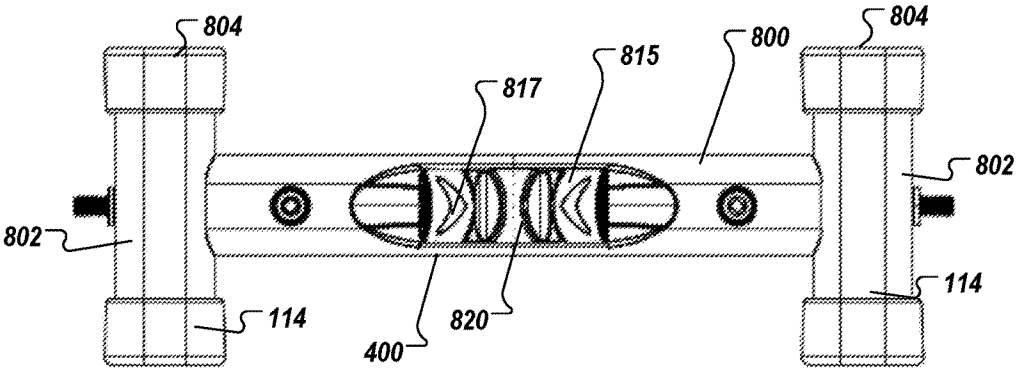
Figure 8C:
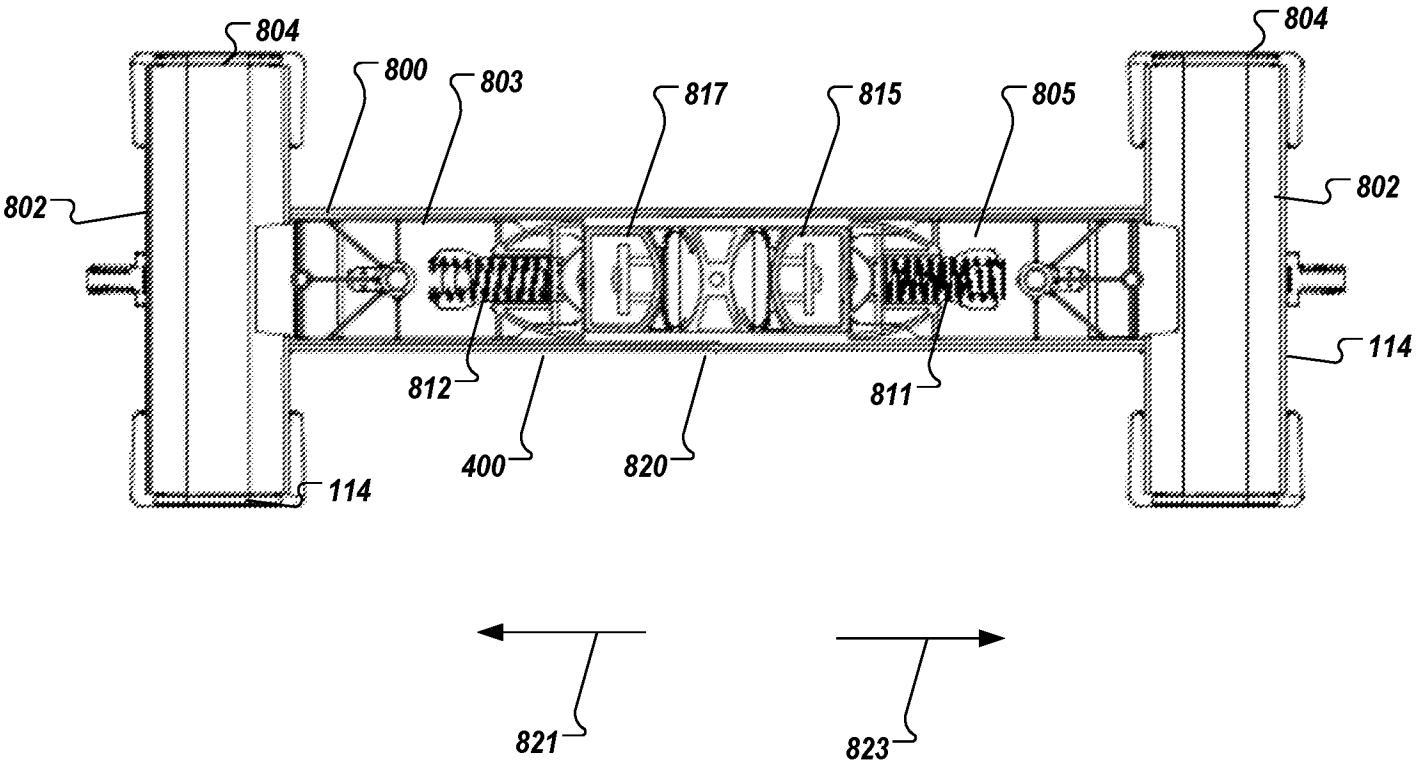

FIGS. 8A-8C illustrate views of an exemplary embodiment of the translation mechanism 114 and an exemplary embodiment of the lateral structure 800. Referring to FIGS. 8A-8C, the translation mechanism 114, the lateral structure 800, and other components therein may be referred to as a translation assembly 114/800. FIG. 8A is a perspective view of the translation assembly 114/800. FIG. 8B is a rear view of the translation assembly 114/800. FIG. 8C is a sectional view of the translation assembly 114/800.

In the translation assembly 114/800, the translation mechanism 114 may be a sleeve or sleeve structure, and the sleeve or sleeve structure may at least partially surround a structure or a portion of a support element (e.g., the support element 112 described above). In particular, the translation assembly 114/800 may include one or more conduits, such as conduits 802A and 802B (generally, conduit 802 or conduits 802), which is an example of the translation mechanism 114. Accordingly, the conduits 802 may be retained relative to a support element, a frame, and/or a brace member. For instance, with reference to FIGS. 8A and 1A, the support element 112 may be received in the conduits 802 such that the conduits 802 may translate relative to the support element. Additionally, the conduits 802 may be coupled to the frame 111 via the brace member 1700.

The conduits 802 may define translation volumes 804. The translation volumes 804 may extend through the entire conduit 802, which may allow the elongated structures (e.g., the legs of the support element) to extend through the conduits 802. The conduits 802 may translate relative to the elongated structures as the support element rotates.

The translation assembly 114/800 may also include the lateral structure 800. The lateral structure 800 may be attached to the conduits 802 at an inner surface of the conduits 802. The lateral structure 800 may be a shell structure in which the lock device 400 may be at least partially positioned or disposed. The lock device 400 may include a compression mechanism 820. The compression mechanism 820 may include one or more buttons, such as two opposed buttons 815 and 817. A user may actuate the compression mechanism 820 by drawing or pushing the two opposed buttons 815 and 817 towards one another. Drawing the opposed buttons 815 and 817 of the compression mechanism 820 towards one another may pull the lock tabs 803 and 805 towards a center portion of the lateral structure 800. With sufficient force, the lock tabs 803 and 805 may be withdrawn from receivers defined in a support element. When the lock tabs 803 and 805 are withdrawn from the receivers and into the lateral structure 800, the conduits 802 may translate relative to the support element.

With reference to FIG. 8C, the lock tabs 803 and 805 may be biased by biasing members such as the springs 812 and 811. For instance, in the depicted embodiment, the lock tabs 803 and 805 may be biased away from one another such that the lock tabs 803 and 805 are biased towards being introduced and retained in the receivers. Specifically, a first lock tab 803 may be biased in a direction indicated by arrow 821 and a second lock tab 805 may be biased in a direction indicated by arrow 823. In other embodiments, the lock tabs 803 and 805 may be otherwise biased. It will be appreciated, however, that the lock tabs can be biased by other means and the lock tabs do not have to be biased.

Figure 9A:
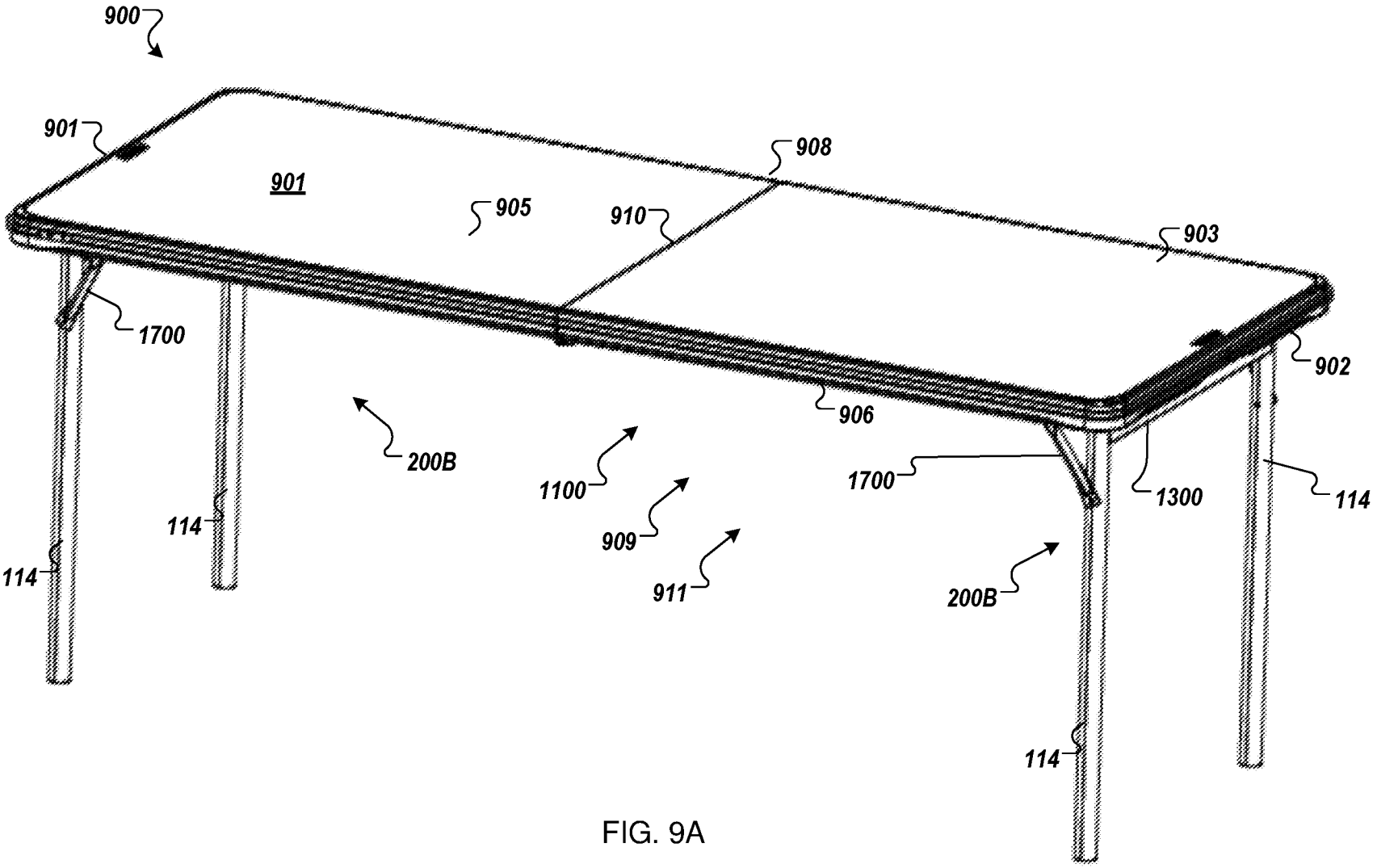
FIG. 9A is an upper perspective view of exemplary table that may implement a first or a second leg assembly.
Figure 9B:
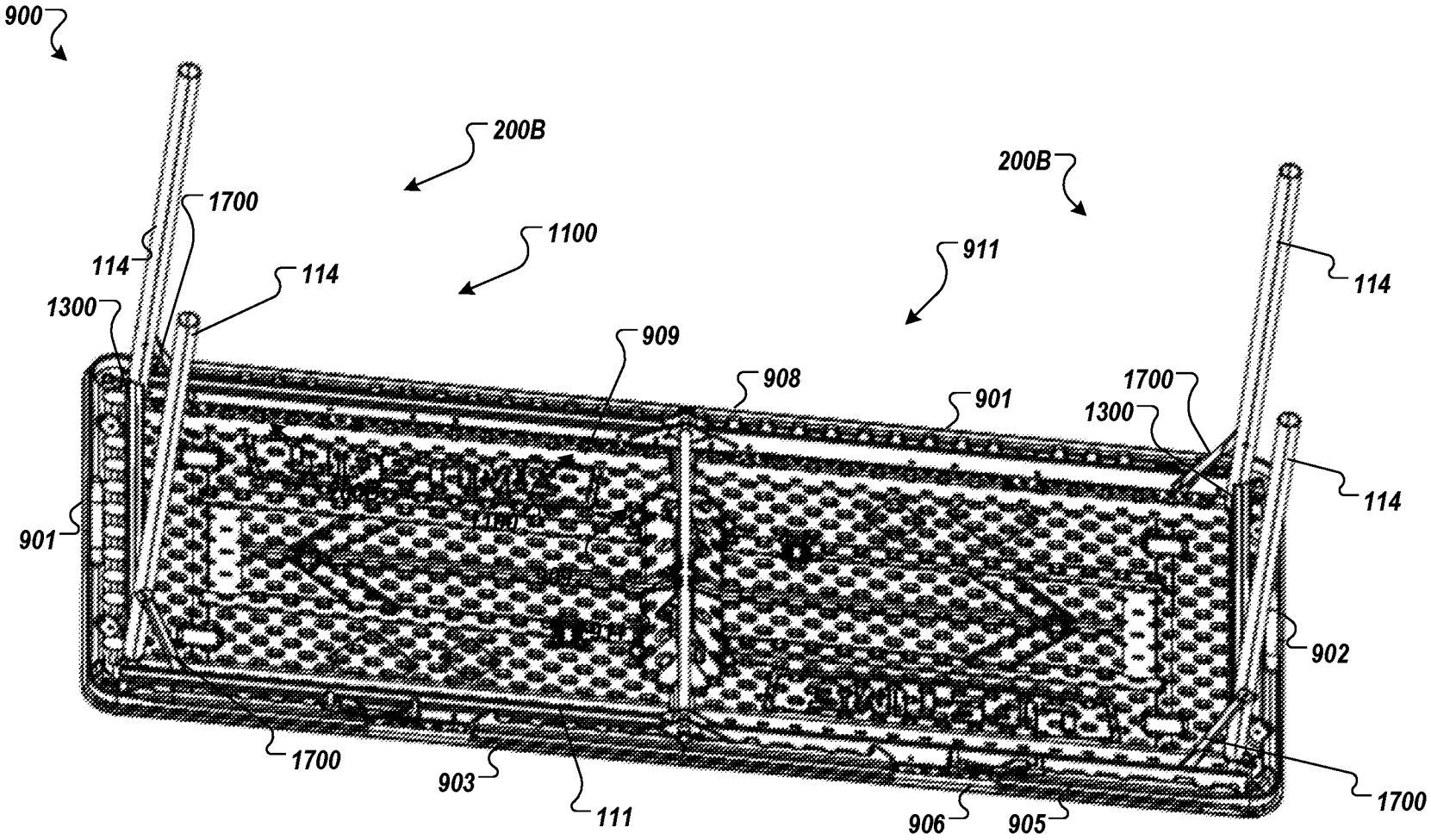
FIG. 9B is a lower perspective view of the table shown in FIG. 9A.

FIGS. 9A-9D illustrate another exemplary table 900 (which may be referred to as a second table 900 for convenience and readability) and the table 900 may implement one or both leg assemblies 200. FIG. 10 is an enlarged view of a portion of the second table 900 depicting the second leg assembly 200B attached to an exemplary tabletop 901. The second table 900 may include the tabletop 901 and the tabletop may be selectively supported by a support assembly 1100. The support assembly 1100 may be configured to support the tabletop 901 relative to a surface such as a floor or the ground. The support assembly 1100 of FIGS. 9A-10 may include the second leg assembly 200B. The second leg assembly 200B may be positioned in a first position and a second position. In the first position, the second leg assembly 200B may be disposed in a storage configuration in which the leg assemblies 200 may be positioned at least adjacent to, in contact with, or at least substantially adjacent to a lower surface 909 of the tabletop 901. Such positioning may reduce a height of the second table 900, which may also reduce a volume used by the second table 900 when the table is being stored. The second position may be a use configuration. In the second position, the second leg assemblies 200B may extend outwardly and may be disposed at least substantially perpendicular to the lower surface 909 of the tabletop 901. The leg assemblies 200B may support the tabletop 901 such that the second table 900 may be used (e.g., a user placing items on the tabletop 901). In FIGS. 9A-10, the leg assemblies 200B are shown in the use configuration.

Figure 9C:
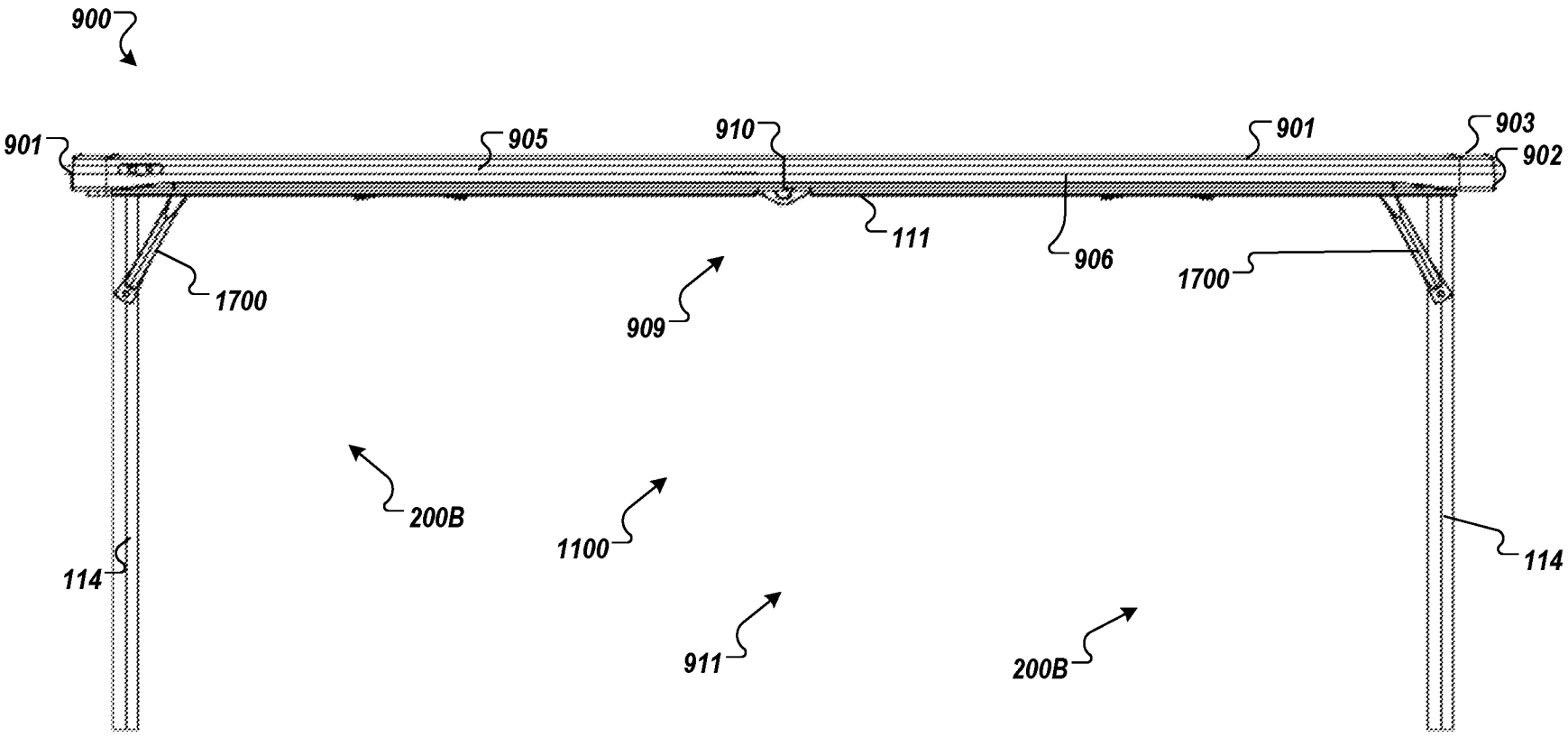
FIG. 9C is a side view of the table shown in FIG. 9A.
Figure 9D:
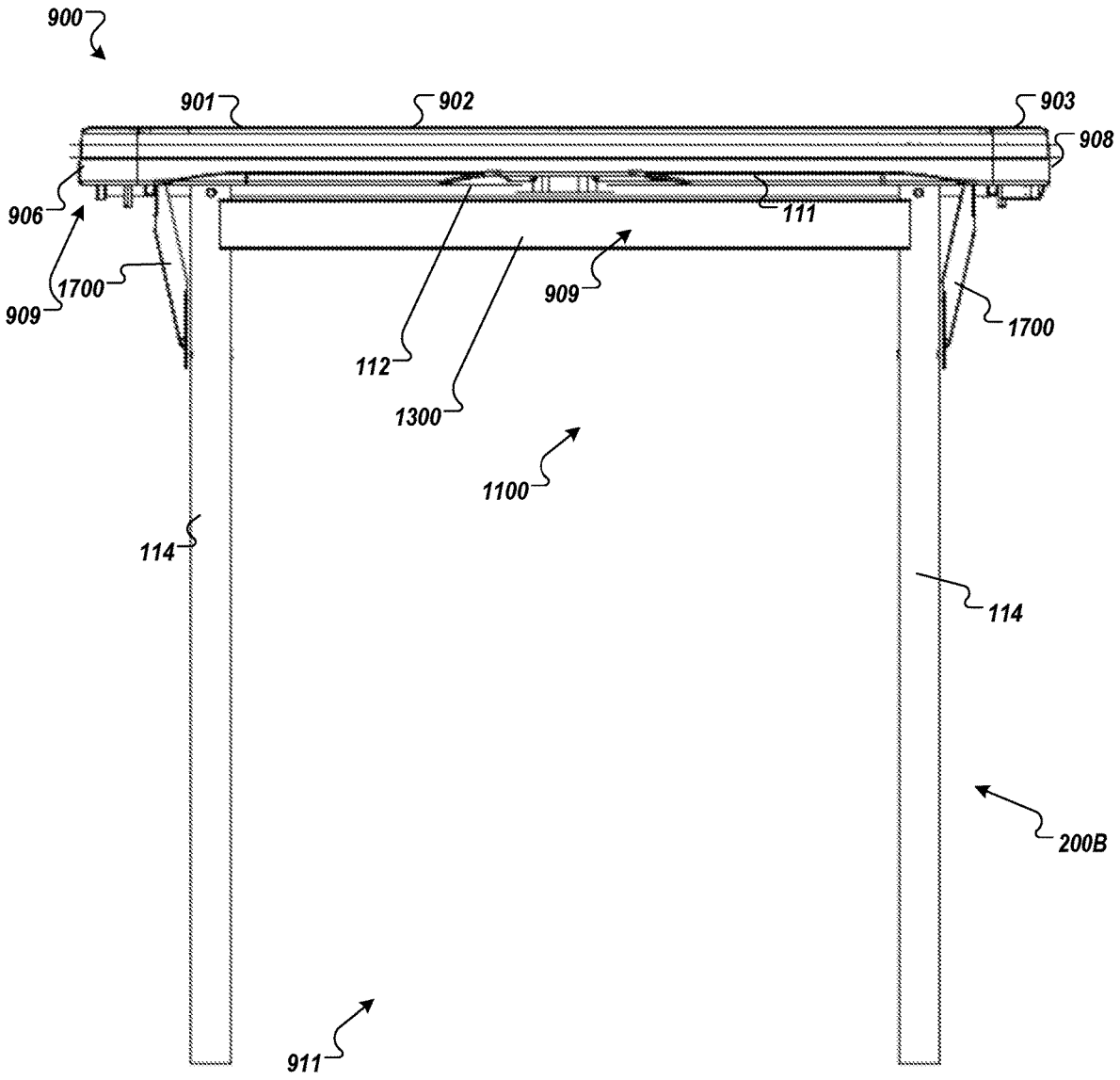
FIG. 9D is an end view of the table shown in FIG. 9A.
Figure 10:
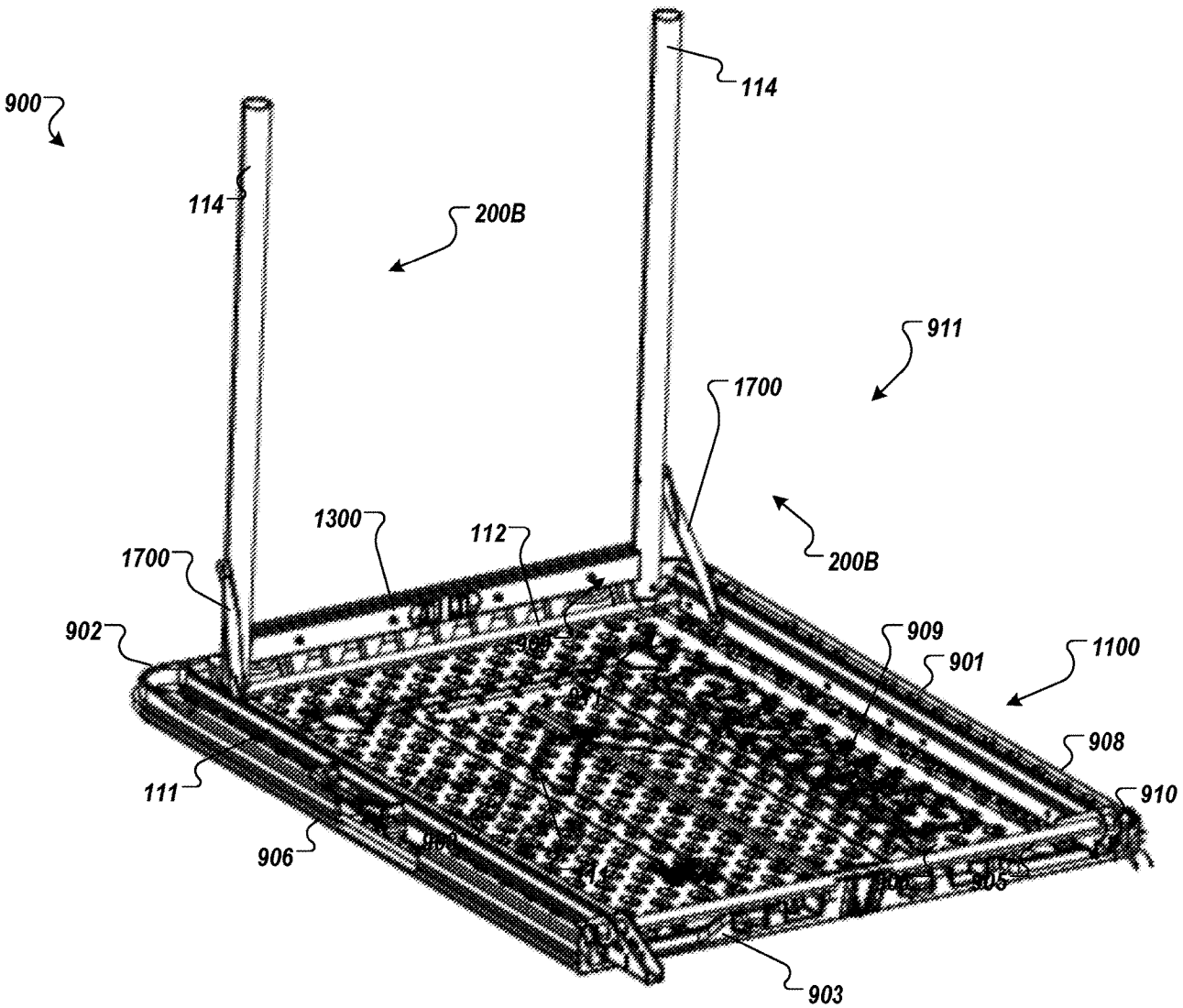
FIG. 10 is an enlarged lower perspective view of a portion of the table shown in FIG. 9A, depicting an exemplary leg assembly attached to an exemplary tabletop.

Referring to FIGS. 9C and 9D, the support assembly 1100 and the leg assemblies 200B may be sized and shaped to open up, increase, and/or vacate the volume, generally indicated by reference number 911, below the tabletop 901. For instance, in some existing tables, the leg assemblies may include an angled support. The angled support may extend from a center of the tabletop to a cross member of the leg assemblies. Accordingly, the angled support may occupy or be disposed in the volume (e.g., 911) below the tabletop. Presence of the angled support may interfere with chairs being placed around the table, positioning of user's legs under table, etc., which may limit the use of the table. Advantageously, one or more exemplary embodiments described in the present disclosure may not include that type of angled support. Specifically, the second table 900 may not include a structure that extends from a center 910 of the tabletop 901 to the leg assemblies 200. Instead, the leg assemblies 200B may include brace members 1700. The brace members 1700 may be coupled between the frame 111 and the leg assemblies 200B. The brace members 1700 may be located near or at least proximate outer edges of the tabletop 101. The locations of the brace members 1700 and the omission of structures in the volume 911 may open up or increase the volume 911 below the tabletop 101.

The second table 900 shown in FIGS. 9A-10 is a fold-in-half table. Accordingly, the tabletop 901 may include a first portion 903 and a second portion 905. The first portion 903 and/or the second portion 905 of the tabletop 901 may be constructed of a blow-molded plastic such as a high-density polyethylene (HDPE). Additionally, or alternatively, the first portion 903 and/or the second portion 905 may be integrally formed as part of a unitary, one-piece structure, that may be formed using a blow molding process. One of ordinary skill in the art, after reviewing this disclosure, will appreciate that the table could be constructed from other suitable materials and processes.

The fold-in-half table shown in FIGS. 9A-10 may have a length of about 72 inches, such as about 71.9 inches, between a first end 902 and a second end 904. The fold-in-half table may have a width of about thirty inches between a first side 906 and a second side 908. In other embodiments, the leg assembly 200B may be implemented in other tables or other structures, which may also be blow-molded structures. Accordingly, after reviewing this disclosure, one of ordinary skill in the art will appreciate that the leg assemblies 200 may be used with other types of tables and structures. For example, the leg assemblies 200 may be implemented in other types of tables or structures, and these tables or structures may be at least partially constructed from blow-molded materials. The leg assemblies 200, however, do not have to be used in connection with tables or structures at least partially constructed from blow-molded materials For instance, the leg assemblies 200B may be implemented in banquet tables (e.g., 72 inch tables, 96 inch tables, etc.), seminar tables, folding tables, nesting tables, round tables, bistro tables, fold-in-half round tables, benches, picnic tables, and the like. Thus, it will be understood that the leg assemblies 200 may be used in connection with any type of table or structure, as desired.

With reference to FIGS. 9A-10, the leg assemblies 200B may include a support element 112 and the support element may be rotatably coupled to the frame 111. The leg assemblies 200B may also include a translation mechanism 114 and the translation mechanism may be retained relative to the support element 112. The brace members 1700 may be coupled between the translation mechanism 114 and the frame 111. As the support element 112 transitions between the first position and the second position, the brace members 1700 may rotate and the translation mechanism 114 may translate along a portion of the support element 112. In the depicted embodiment, for the support element 112 to rotate, the translation mechanism 114 may translate and the brace member 1700 may rotate. Accordingly, to in the use configuration, the leg assembly 200 may be locked, which may secure the translation mechanism 114 relative to the support element 112.

For example, the leg assemblies 200B may include a lock device 400. The lock device 400 may be configurable in an engaged arrangement in which the lock device 400 may fix the translation mechanism 114 to the support element 112. The lock device 400 may be configured in the engaged arrangement when the leg assemblies 200B are disposed in the use configuration. Accordingly, in the engaged arrangement the leg assemblies 200 may be fixed such that the translation mechanism 114 cannot translate relative to the support element 112. Also, the lock device 400 may also be configurable in a disengaged arrangement in which the translation mechanism 114 may not be fixed relative to the support element 112. In the disengaged arrangement, the leg assemblies 200 may transition from the second position to the first position or between a use configuration and a storage configuration.

Referring to FIG. 9B, the second table 900 may include the second leg assembly 200B. In other embodiments, the second table 900 may include one or two of the first leg assemblies 200A or other suitable leg assemblies.

Figure 11A:
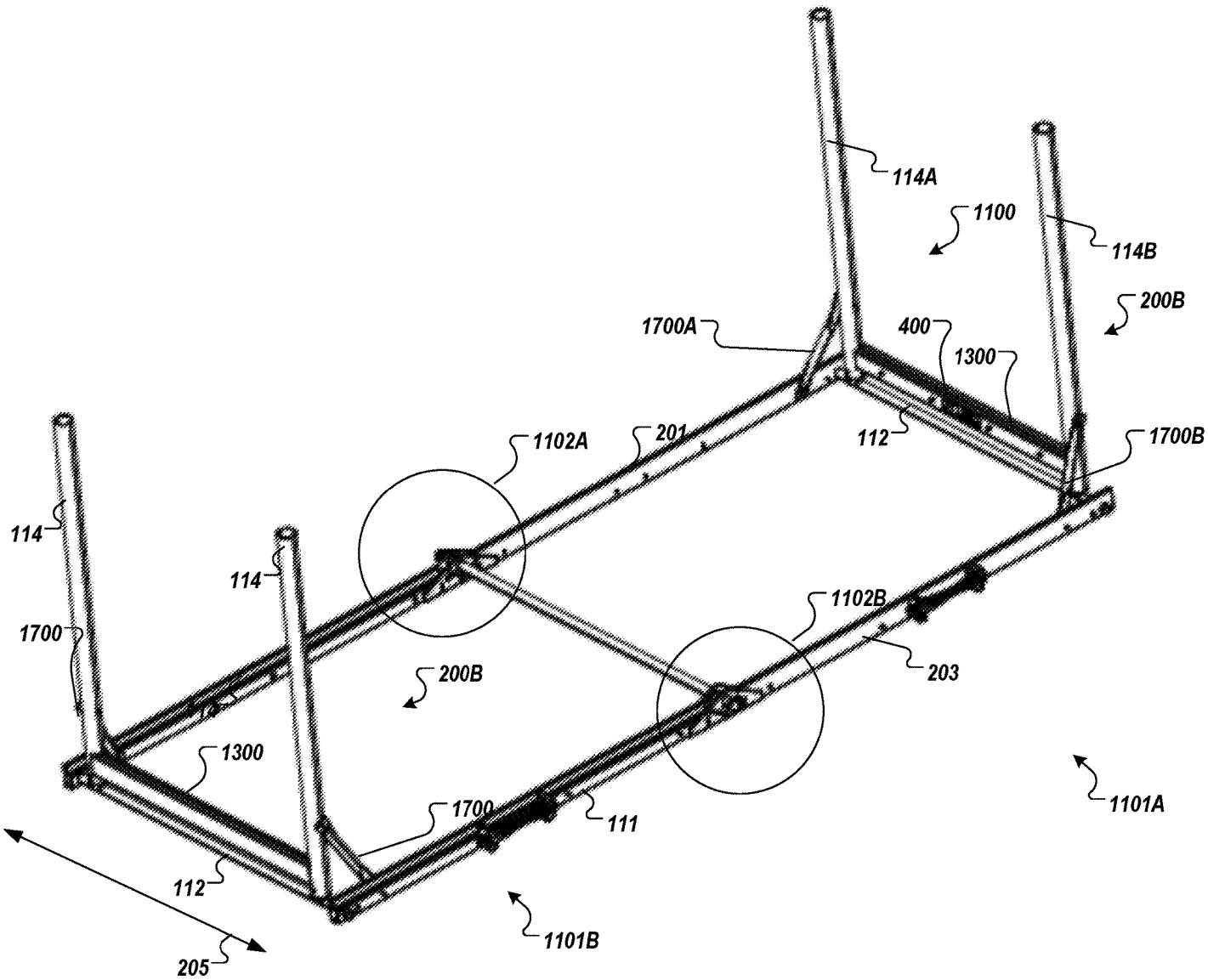
FIG. 11A is a perspective view an exemplary support assembly, illustrating exemplary leg assemblies in a use arrangement.
Figure 11B:
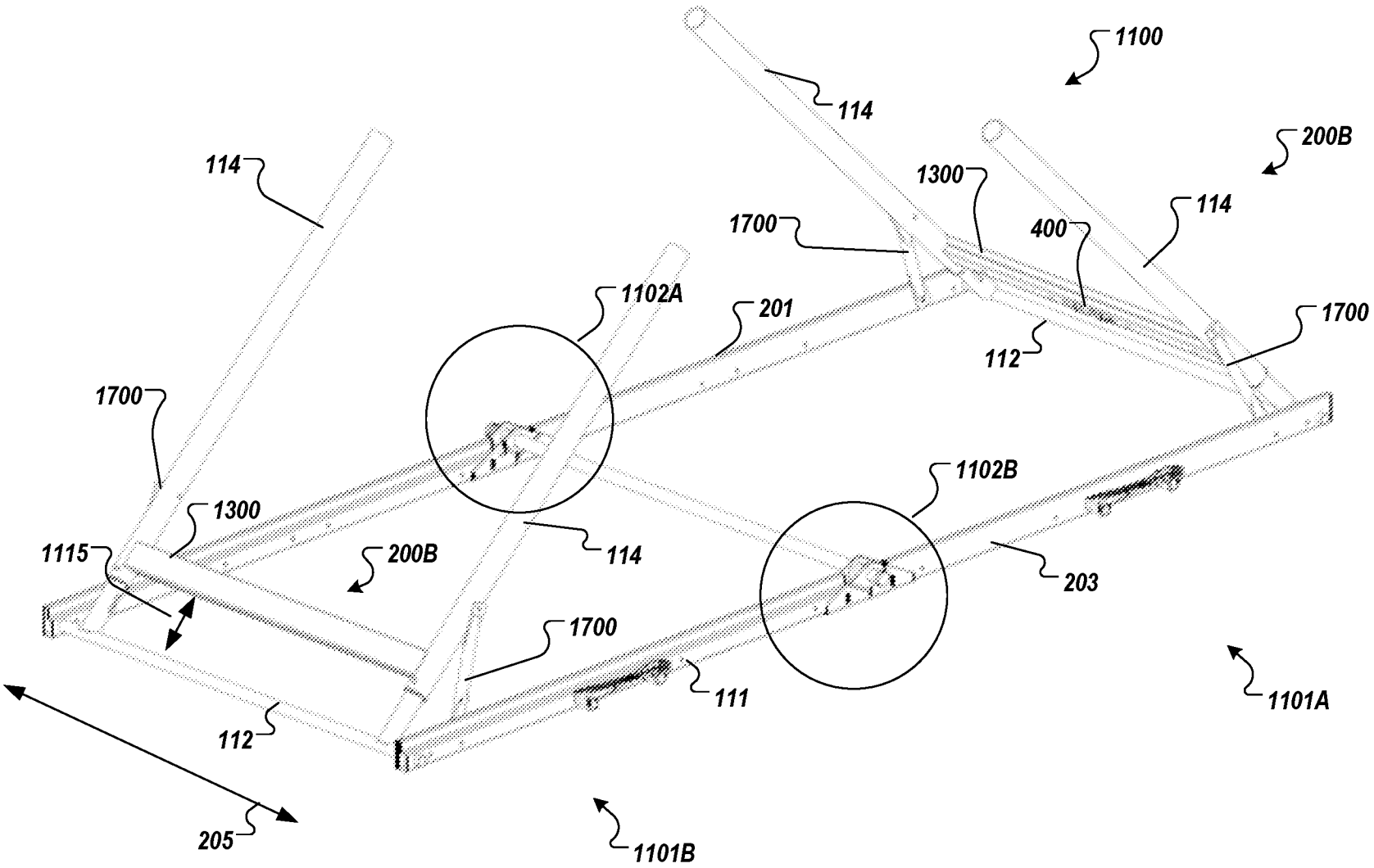
FIG. 11B is another perspective view of the support assembly shown in FIG. 11A, illustrating the leg assemblies in a partially folded arrangement.
Figure 11C:
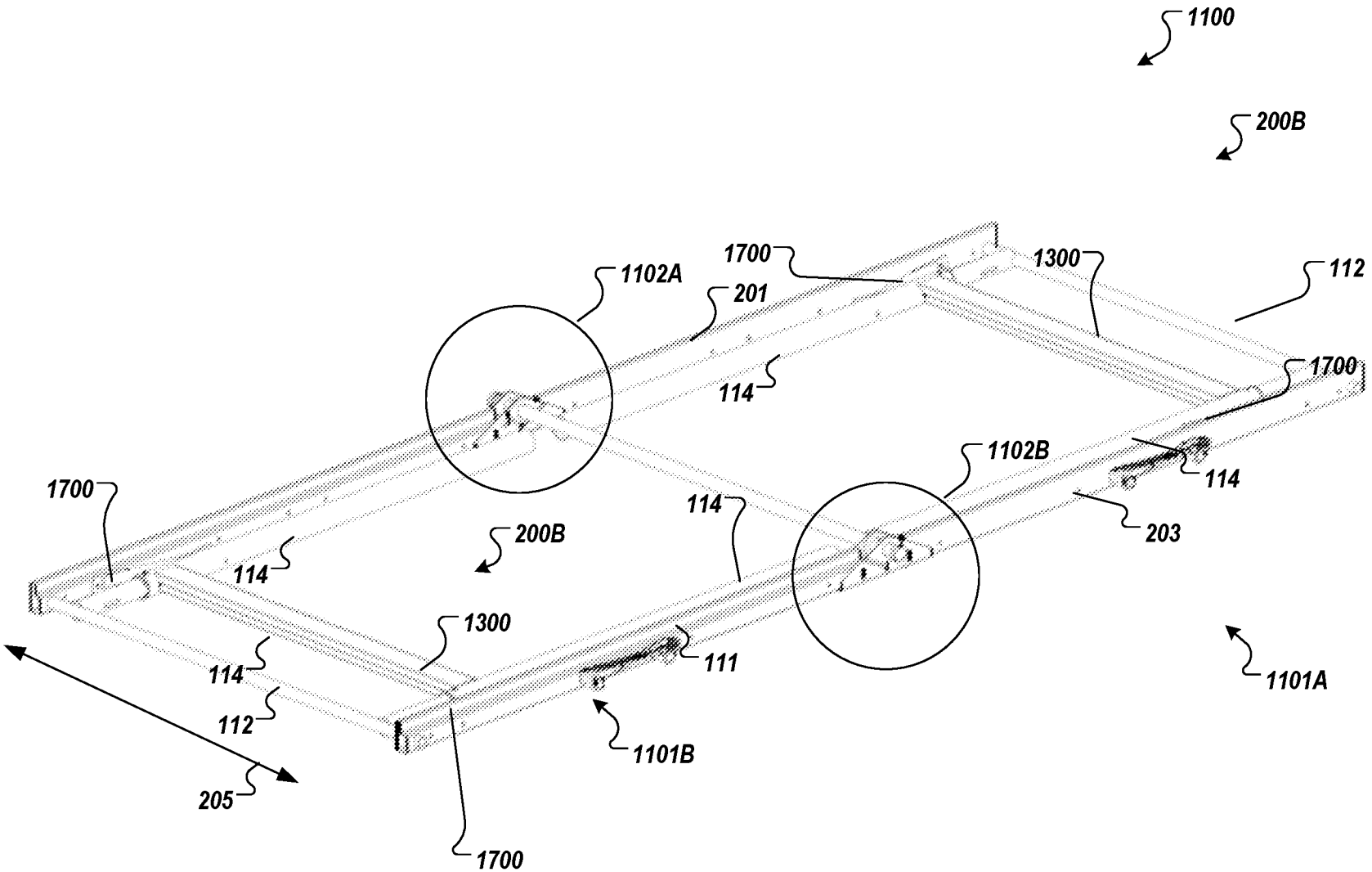
FIG. 11C is another perspective view of the support assembly shown in FIG. 11A, illustrating the leg assemblies in a storage arrangement.

FIGS. 11A-11C illustrate an exemplary embodiment of the support assembly 1100 that may be implemented. For example, the support assembly 110 may be implement in the second table 900, such as shown in FIGS. 9A-9D, or the first table 100, such as shown in FIGS. 1A-1D. FIG. 11A illustrates the support assembly 1100 with the second leg assemblies 200B configured in a use arrangement. FIG. 11B illustrates the support assembly 1100 of FIG. 11A with the leg assemblies 200B in a partially folded arrangement. FIG. 11C illustrates the support assembly 1100 of FIG. 11A with the leg assemblies 200B configured in a storage arrangement.

With reference to FIGS. 11A-11C, the support assembly 1100 may include the frame 111 and/or the leg assemblies 200B. The support assembly 1100 may be generally configured to selectively support a structure, such as a tabletop (e.g., the tabletop 101 shown in FIGS. 1A-1D or the tabletops 901A and 901B shown in FIGS. 9A-9D). In the depicted embodiment, the support assembly 1100 may be configured for use with a fold-in-half table. Some additional embodiments of a suitable fold-in-half table may be as described in U.S. Pat. No. 8,573,139, which is incorporated herein by reference in its entirety. The frame 111 shown in FIGS. 11A-11C may include one or more hinges, such as hinges 1102A and 1102B, which enable a first portion 1101A of the support assembly 1100 to be folded over on a second portion 1101B of the support assembly 1100.

The support assembly 1100 may also be used in other tables (e.g., banquet tables, round tables, etc.), other structures (e.g., benches, etc.), and the like. One of ordinary skill in the art, after reviewing this disclosure, will appreciate that some adaptations of the table 100, the frame 111, the support assembly 1100, etc. may be desired or needed depending, for example, upon the type of table or structure. For instance, the frame 111 may need to be modified to use the support assembly 1100 with the table 100. The leg assemblies 200B, however, in an exemplary embodiment, may operate substantially as described in the following paragraphs.

With reference to FIGS. 11A-11C, the leg assemblies 200B may be configured to rotate relative to the frame 111. For instance, the leg assemblies 200B may rotate from a first angular position in which the leg assemblies 200B may be disposed at least substantially perpendicular to the frame 111 (such as shown in FIG. 11A) to a second angular position in which the leg assemblies 200B may be disposed at least substantially parallel to the frame 111 (such as shown in FIG. 11C). FIG. 11B depicts the leg assemblies 200B transitioning from the first angular position to the second angular position.

The support assembly 1100 may include the frame 111, the support element 112, the translation mechanism 114, the lock device 400, the brace members 1700, and/or the lateral structure 1300. The frame 111 may include the first longitudinal structure 201 and the second longitudinal structure 203. The first longitudinal structure 201 may be separated by the lateral frame dimension 205 from the second longitudinal structure 203. The leg assemblies 200B may be positioned within the first and second longitudinal structures 201 and 203. For instance, with reference to FIG. 11A, a first brace member 1700A may be rotatably coupled to the first longitudinal structure 201 at or proximate a first end and to a first translational mechanism 114A at or proximate a second end. The first translational mechanism 114A may be retained relative to the support element 112, which may be rotatably coupled to the frame 111. The first translational mechanism 114A may be coupled to a second translational mechanism 114B by the lateral structure 1300. The second translational mechanism 114B may also be retained relative to the support element 112. The second translational mechanism 114B may be coupled to a second brace member 1700B at a first end. At a second end of the second brace member 1700B, the brace member 1700B may be rotatably coupled to the second longitudinal structure 203. Accordingly, the second leg assembly 200B and the brace members 1700 may be located between the first and second longitudinal structures 201 and 203.

Referring to FIG. 11A, the second leg assemblies 200B may be disposed in a use configuration. In the use configuration, the leg assemblies 200B may be disposed at least substantially perpendicular to the frame 111. The translation mechanisms 114 may be positioned on a surface to support the frame 111 above the surface. In the use configuration, the lock device 400 may be in an engaged arrangement. In the engaged arrangement, the lock device 400 may fix the translation mechanism 114 relative to the support element 112. Also, in the use configuration, the translation mechanism 114 may translate towards the support element 112 and the brace members 1700 may be oriented at an angle relative to the translation mechanism 114.

Referring to FIG. 11B, to transition the second leg assemblies 200B, the lock device 400 may be transitioned from the engaged arrangement to a disengaged arrangement. When the lock device 400 is in the disengaged arrangement, the translational mechanism 114 may not be fixed to the support element 112. Accordingly, the translational mechanism 114 may translate relative to the support element 112 as the support element 112 rotates relative to the frame 111. Additionally, the brace members 1700 may rotate with the translational mechanism 114 as the support element 112 rotates. In particular, with reference to FIG. 11B, the second leg assembly 200B on the left of the figure may rotate in a direction represented by arrow 1119. As the second leg assembly 200B rotates in the direction 1119, the brace member 1700 may rotate in the same direction, which is represented by arrow 1117. Moreover, as the second leg assembly 200B rotates, a distance 1115 between the lateral structure 1300 and the support element 112 may increase.

Referring to FIG. 11C, the support assembly 1100 is depicted in a storage configuration. In the storage configuration, the leg assemblies 200B may be disposed at least substantially parallel to the frame 111. The translation mechanisms 114 may be positioned in a volume defined by the frame 111. In the storage configuration, the lock device 400 may also be in the disengaged arrangement, which may allow the translational mechanism 114 to translate relative to the support element 112. Also, in the storage configuration, the brace members 1700 may be positioned between the translational mechanism 114 and an inner surface of the frame 111.

Figure 12:
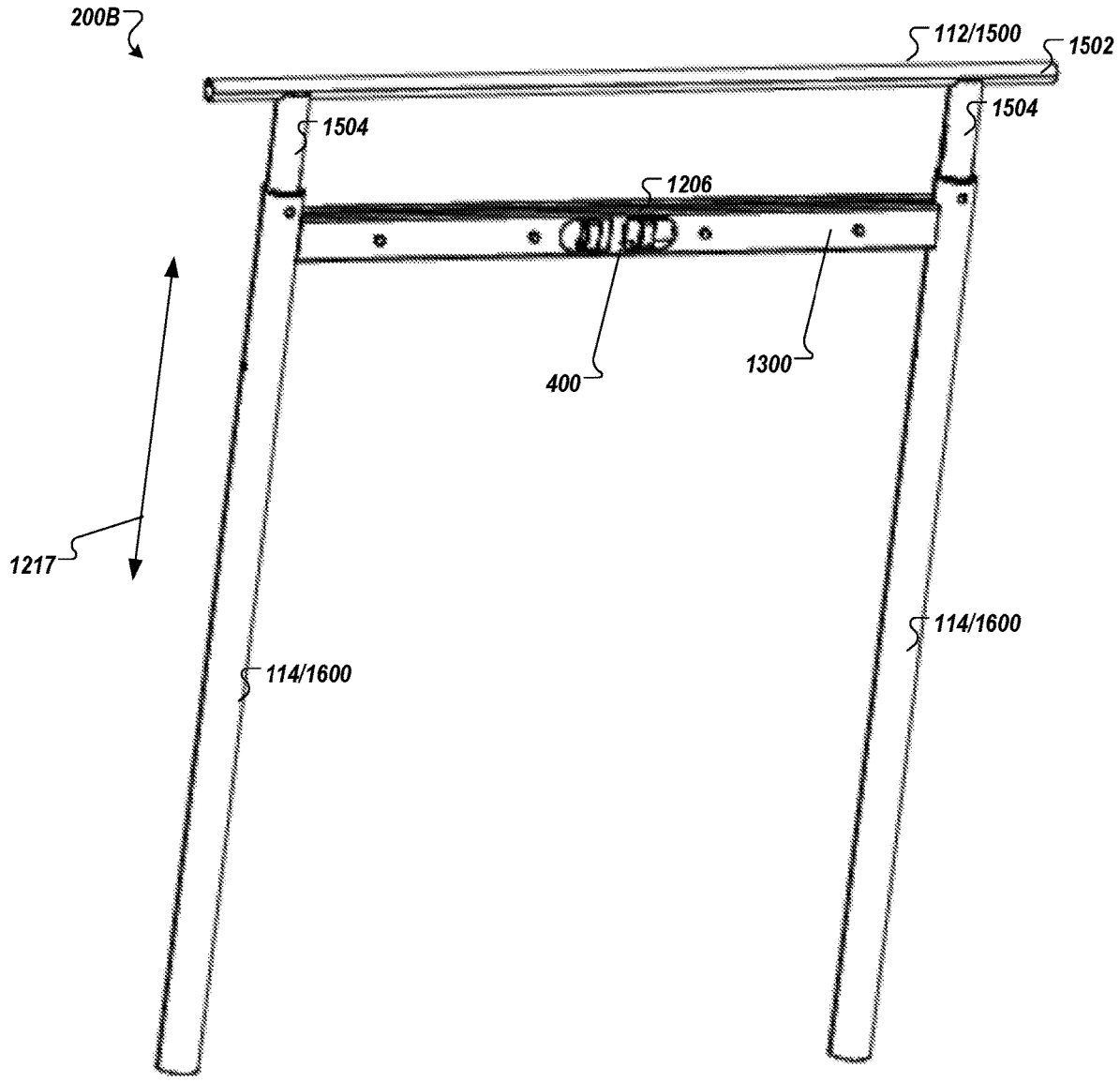
FIG. 12 is a perspective view an exemplary embodiment of a leg assembly.
Figure 13:
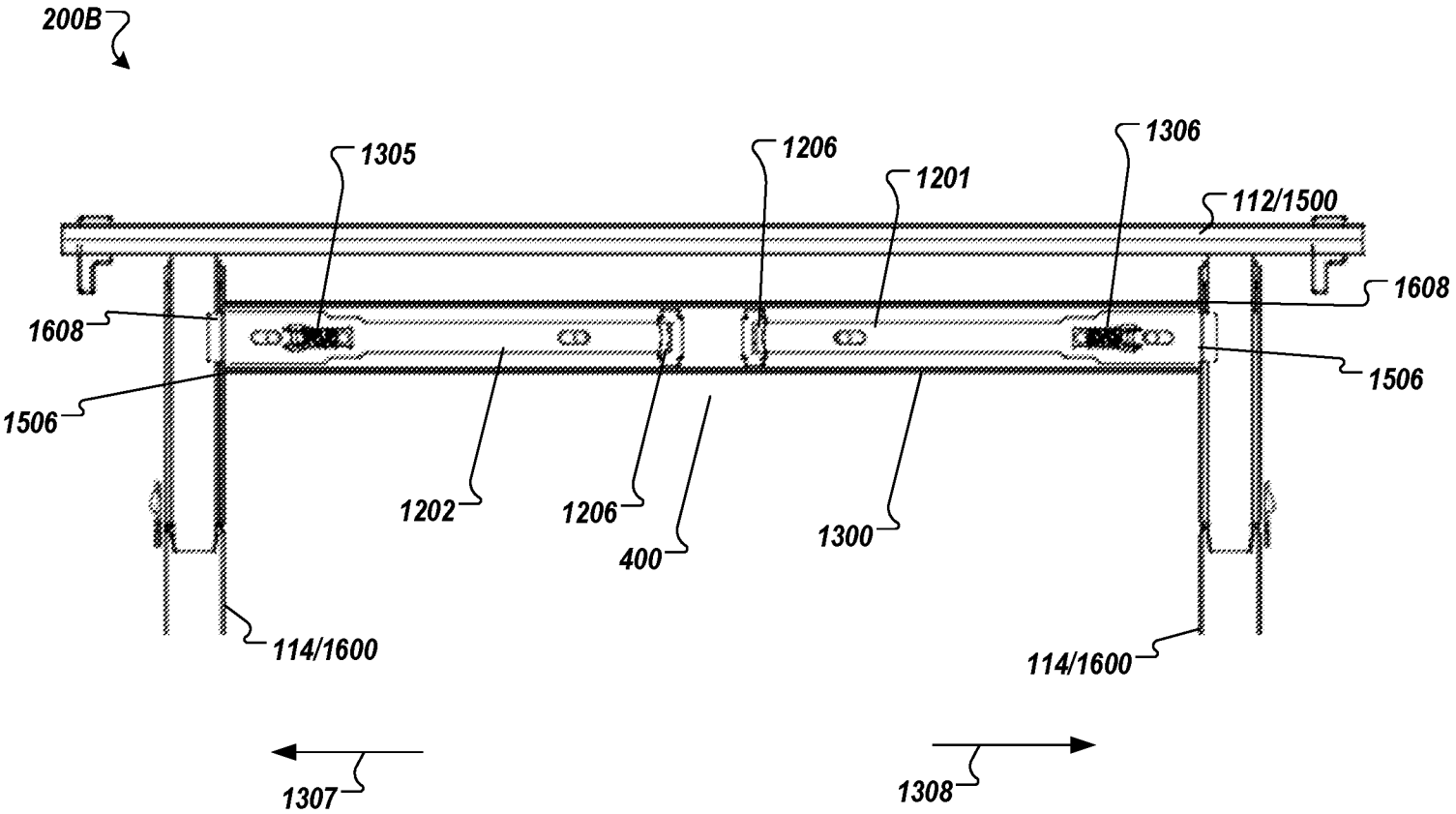
FIG. 13 is a sectional view of a portion of an exemplary leg assembly.
Figure 14A:
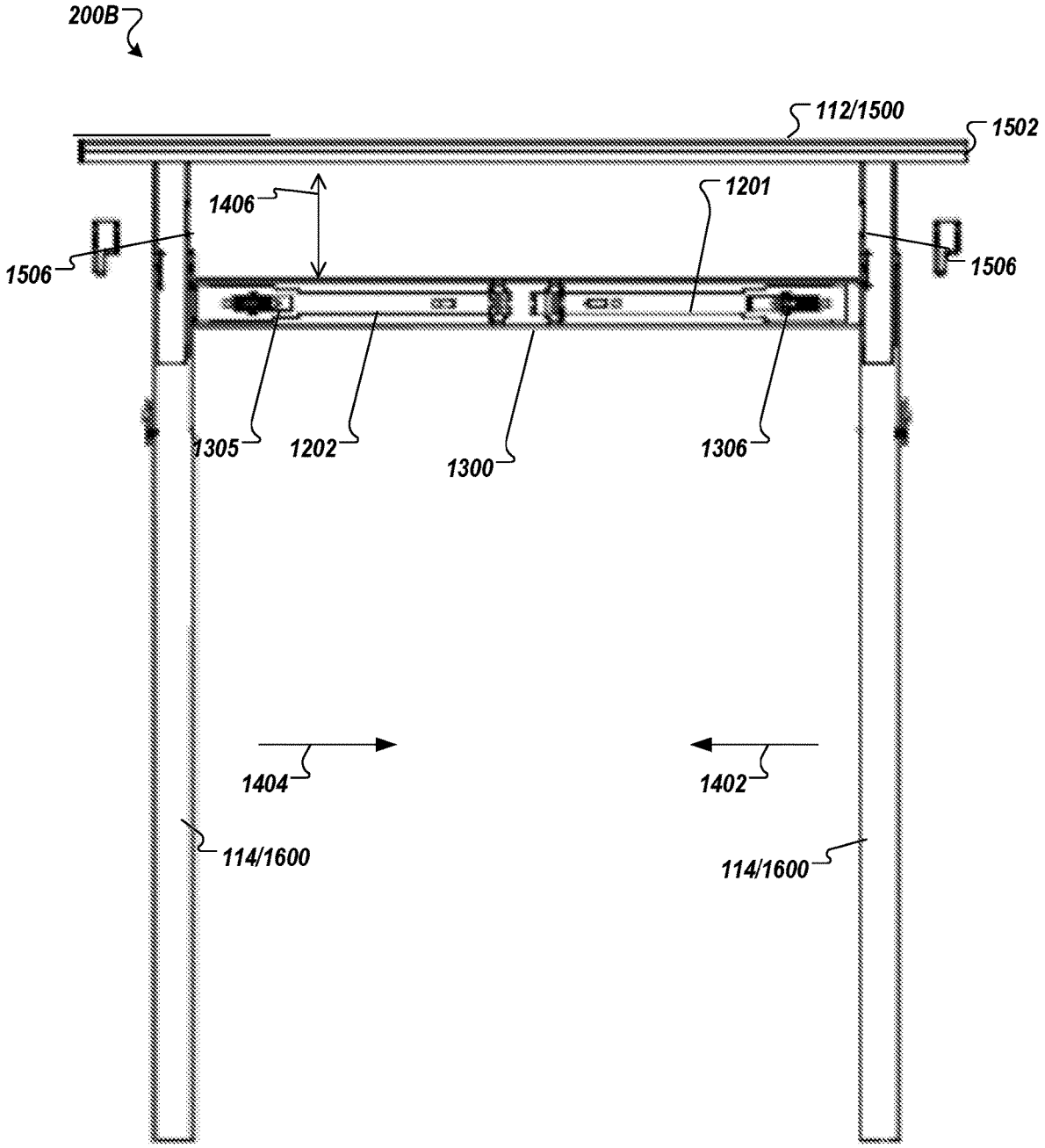
FIG. 14A illustrates an exemplary leg assembly and an exemplary translation mechanism, illustrating the translation mechanism translating on the support element.
Figure 14B:
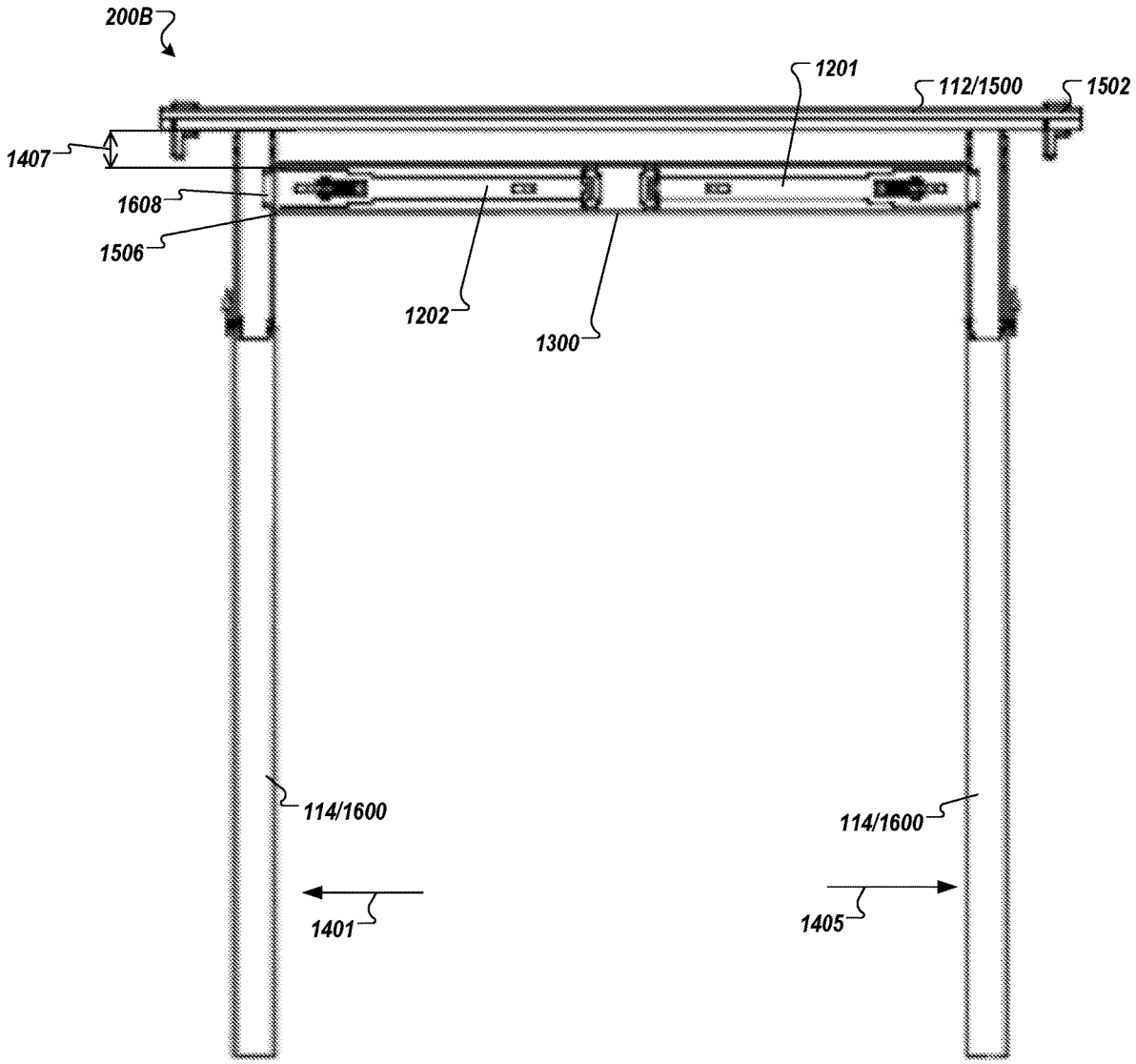
FIG. 14B illustrates an exemplary leg assembly and an exemplary translation mechanism, illustrating the translating mechanism translating on the support element.

FIG. 12 illustrates an exemplary embodiment of the second leg assembly 200B that may be implemented with a structure such as a table (e.g., the first table 100 and/or the second table 900). FIG. 13 depicts a sectional view of a portion of the second leg assembly 200B shown in FIG. 12. FIGS. 14A and 14B illustrate the second leg assembly 200B with an exemplary translation mechanism 114/1600 that may be translating on an exemplary support element 112/1500.

With combine reference to FIGS. 12-14B, the second leg assembly 200B may include the support element 112, the translation mechanism 114, the lock device 400, and/or the lateral structure 1300. The support element 112 of the second leg assembly 220, as shown in FIGS. 12-14B, is also labeled "1500," which is further described in connection with FIG. 15. The second leg assembly 200 may include one or more translation mechanisms, such as two translation mechanisms 114. As shown in FIG. 12, the translation mechanism 114 may include a sleeve structure and the sleeve structure may at least partially surround the elongated structure 1504 of the support element 112. The translation mechanisms are also labeled "1600" to correspond to a leg, which is further described with reference to FIG. 16.

The support element 112 may be rotatably coupled to a first longitudinal structure and a second longitudinal structure. For example, the support element 112 may include an end structure 1502 attached to an elongated structure 1504. The end structure 1502 may be rotatably coupled to the first longitudinal structure and the second longitudinal structure such that the leg assembly 200B may be rotatable relative to the frame between a first position and a second position. The elongated structure 1504 may extend into the translation mechanism 114, which may be configured to translate along a portion of the support element 112 as the support element 112 rotates relative to the frame.

The translation mechanism 114 may be retained relative to the support element 112. For instance, the translation mechanism 114 may be slidably retained relative to the support element 112 such that the translation mechanism 114 translates relative to the support element 112 in a particular direction. In the embodiment shown in FIG. 12, the translation mechanism 114 may translate in a direction indicated by arrow 1217. Because the brace members (1700) may be rotatably coupled between the translation mechanism 114 and the frame, in order for the support element 112 to rotate, the translation mechanism 114 may translate. Accordingly, fixing the translation mechanism 114 relative to the support element 112 may prevent the support element 112 from transitioning between the use position and the storage position.

The lateral structure 1300 may be attached to the translation mechanism 114. For example, in the depicted embodiment, the lateral structure 1300 may extend from a first translation mechanism 114 (e.g., a first leg 1600) to a second translation mechanism 114 (e.g., a second leg 1600).

The lateral structure 1300 may be a shell structure, which may be configured to retain the lock device 400. Accordingly, the lock device 400 may be at least partially disposed in the lateral structure 1300. The lock device 400 may include a compression mechanism 1206. The compression mechanism 1206 may include one or more buttons, such as two opposed buttons. A user may actuate the compression mechanism 1206 by drawing or pushing the two opposed buttons towards one another. The act of drawing the opposed buttons of the compression mechanism 1206 towards one another may pull lock tabs 1201 and 1202 towards a center portion of the leg assembly 200B. With sufficient force, the lock tabs 1201 and 1202 may be withdrawn from receivers 1506 defined in the support element 112. When the lock tabs 1201 and 1202 are withdrawn from the receivers 1506 and into the lateral structure 1300, the translation mechanism 114 may translate relative to the support element 112.

The lock device 400 may be configurable in two arrangements. In an engaged arrangement, which is shown in FIGS. 13 and 14B, the lock tabs 1201 and 1202 may extend from the sides of the lateral structure 1300 and may be received in the receiver 1506. The lock tabs 1201 and 1202 may also extend through openings 1608 in the translation mechanism 114. In the engaged arrangement, the lock device 400 may fix the translation mechanism 114 relative to the support element 112. Accordingly, the translation mechanism 114 may not translate relative to the support element 112, which may prevent the support element 112 from rotating.

With reference to FIG. 13, the lock tabs 1201 and 1202 are depicted engaged in the receiver 1506, which may correspond to the engaged arrangement of the lock device 400. The lock tabs 1201 and 1202 may be biased by a biasing member, such as springs 1305 and 1306. For instance, in the depicted embodiment, the lock tabs 1201 and 1202 may be biased away from one another such that the lock tabs 1201 and 1202 are biased towards being introduced and retained in the receivers 1506. Specifically, a first lock tab 1201 may be biased in a direction indicated by arrow 1307 and a second lock tab 1202 may be biased in a direction indicated by arrow 1308. In other embodiments, the lock tabs 1201 and 1202 may be otherwise biased. It will be appreciated that the lock tabs can be biased by other means, the lock tabs do not have to be biased, and the lock tabs may have other suitable shapes, sizes, configurations, and/or arrangements, depending, for example, upon the lock device and/or the table.

Referring back to FIGS. 12-14B, the lock device 400 may also be configurable in a disengaged arrangement, which is depicted in FIGS. 12 and 14B. In the disengaged arrangement, the lock tabs 1201 and 1202 may be withdrawn from the receivers 1506 and into the lateral structure 1300. The translation mechanism 114 may accordingly translate relative to the support element 112, which may enable the support element 112 to rotate relative to a frame. To transition the lock device 400 from the engaged arrangement to the disengaged arrangement, a user may press the buttons on the compression mechanism 1206 towards one another. The buttons may translate these forces to the lock tabs 1201 and 1202 and retract them from the receivers 1506.

Referring to FIGS. 14A and 14B, the second leg assembly 200A is depicted in the disengaged arrangement and the engaged arrangement, respectively. Referring to FIG. 14A, the lock tabs 1201 and 1202 may be pulled towards one another. The directions the lock tabs 1201 and 1202 are moved are represented in FIG. 14A by arrows 1402 and 1404. The force applied to the buttons may be sufficient to overcome a force, such as a spring force applied by springs 1305 and 1306. With the lock tabs 1201 and 1202 withdrawn from the receivers 1506, the translation mechanism 114 may translate relative to the support element 112. For instance, a distance 1406 between the end structure 1502 and a top of the lateral structure 1300 may increase.

In FIG. 14B, the lock tabs 1201 and 1202 may be pressed away from one another by the springs 1305 and 1306. When the lock tabs 1201 and 1202 are aligned with the receivers 1506, the lock tabs 1201 and 1202 may extend through the openings 1608 of the translation mechanisms 114 and into the receivers 1506. The directions the lock tabs 1201 and 1202 may move because of the springs 1305 and 1306 are represented in FIG. 14B by arrows 1401 and 1405. With the lock tabs 1201 and 1202 positioned in the receivers 1506, the translation mechanism 114 may be fixed to the support element 112, which may fix a distance 1407 between the end structure 1502 and a top of the lateral structure 1300.

Figure 15:
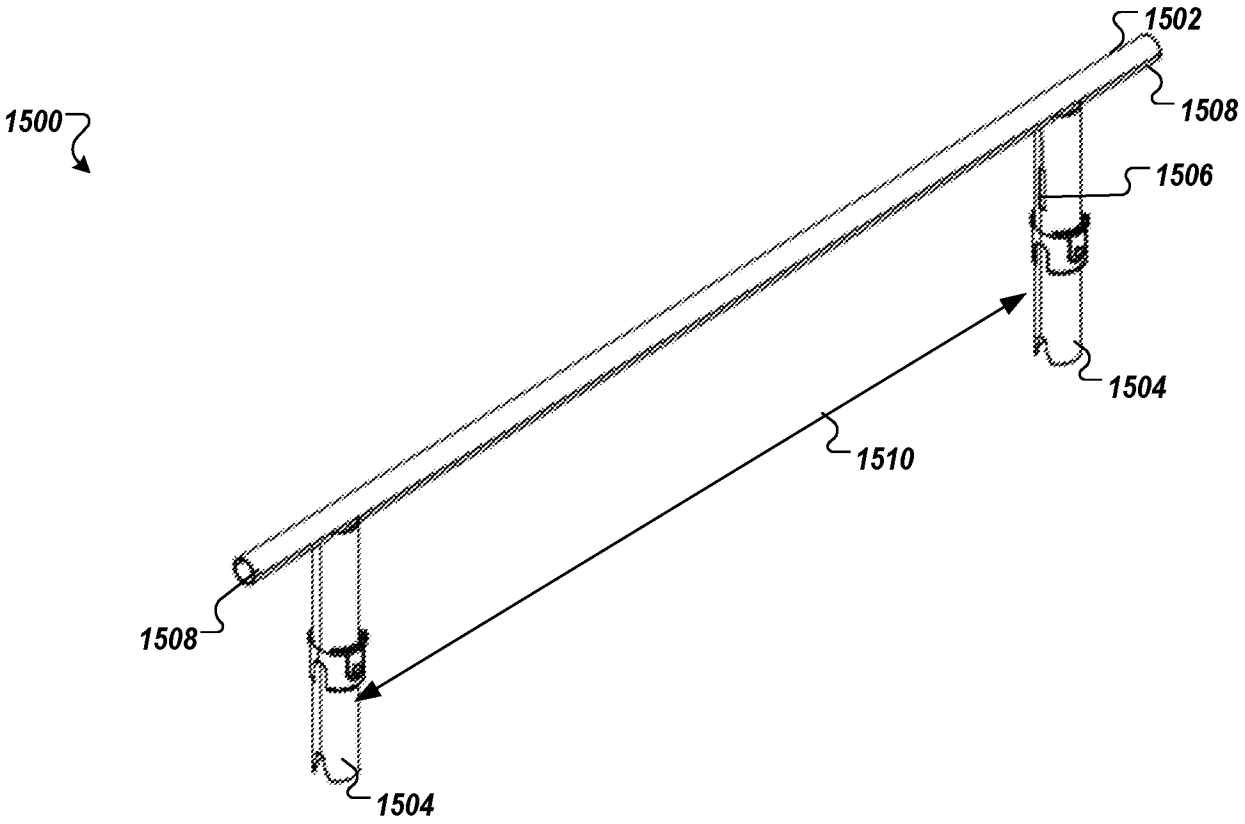
FIG. 15 illustrates an exemplary support element, and the support element may be implemented in an exemplary leg assembly.

FIG. 15 illustrates an exemplary support element 1500 and the support element may be implemented in the second leg assembly 200. The support element 1500 is an example of the support element 112 described above. Accordingly, the support element 1500 may be configured to be rotatably attached to a first longitudinal structure and a second longitudinal structure of a frame (e.g., the frame 111 described above).

The support element 1500 may include an end structure 1502 and the end structure may be attached to one or more elongated structures 1504, which may be referred to in the embodiment of FIG. 15 as shaft supports. The shaft supports 1504 may extend substantially perpendicular to the end structure 1502. The shaft supports 1504 may each be configured to be received within a translation volume of a leg. For instance, the shaft supports 1504 may include a diameter and a length that enables the elongated structures 1504 to be received in the translation volume and for a corresponding translation mechanism to translate relative to the support element 1500.

The two support shafts 1504 may be separated by shaft support separation distance 1510. The shaft support separation distance 1510 may be less than a lateral frame dimension (e.g., 205), which may be between the first and the second longitudinal structures of a frame. Thus, the support shafts 1504 may be positioned within the fame of a table.

The end structure 1502 may be rotatably coupled to the frame. For example, the outer portions 1508 may be received by the first and the second longitudinal structures of the frame such that the support element 1500 may be rotatable relative to the frame from the first position to the second position. The end structure 1502 may be rotatable relative to the frame, but the end structure may be fixed relative to the frame such that the end structure 1502 cannot be displaced.

The elongated structures 1504 may each define at least a portion of a receiver, such as a receiver 1506 shown in FIG. 15. The receiver 1506 may be positioned on an inner surface of the elongated structures 1504 and the receivers 1506 may face one another. The receiver 1506 may be sized and shaped to receive a lock tab that extends from the lock device (e.g., 400) when the lock device is configured in the engaged arrangement. The size and position of the receivers 1506 may correspond to openings on legs (e.g., the opening 1608 of the leg 1600 of FIG. 16). Accordingly, the lock tab may extend through the opening in the leg and into the receiver 1506. As described above, in some embodiments, the lock tabs may be biased by a biasing member (e.g., a spring) such that the lock tabs are positioned in the receiver 1506.

Figure 16:
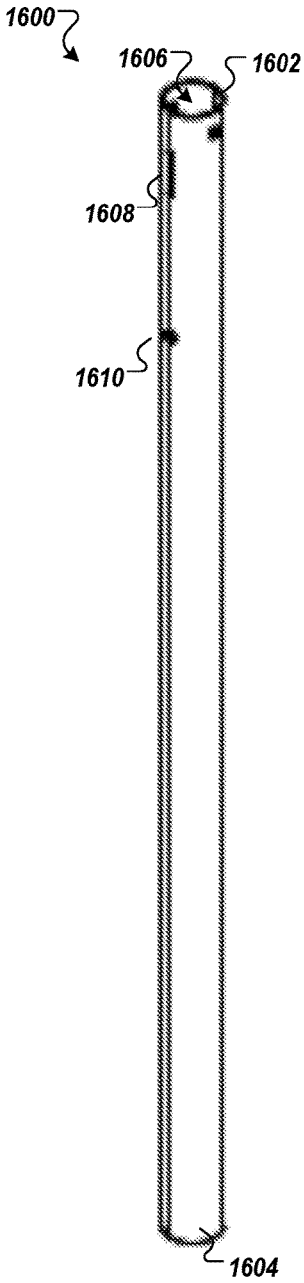
FIG. 16 illustrates an exemplary leg, and the exemplary leg may be implemented in an exemplary leg assembly.

FIG. 16 illustrates an exemplary leg 1600 and the leg may be implemented in a leg assembly in some embodiments, such as the second leg assembly 200B. Exemplary embodiments of the second leg assembly 200B may include two legs, such as the legs 1600 shown in FIG. 16, which may be positioned on either side of the support element (e.g., the support element 1500 of FIG. 15 or support element 112). The leg 1600 shown in FIG. 16 is an example of the translation mechanism 114 described in the present disclosure. Accordingly, the leg 1600 may be configured to translate relative to the support element. For example, when the support element rotates from the first position to the second position, the leg 1600 may translate relative to the support element.

The leg 1600 of FIG. 16 may be substantially cylindrical and may extend from a first end 1602 to a second end 1604. At or at least proximate the first end 1602, the leg 1600 may define a translation volume 1606 in which a support shaft of the support element may be disposed. As the support element rotates, the leg 1600 may translate relative to the support shaft, while maintaining the support shaft within the translation volume 1606.

The leg 1600 may also define an opening 1608 and the opening may be configured to receive the lock tab from a lock device (e.g., lock device 400). The opening 1608 may be positioned to correspond to a receiver in the support shaft when the leg assembly 200B is in a use position. Thus, the lock tab may be disposed in the opening 1608 and the receiver when the leg assembly 200B is in the use position. The leg 1600 may also define one or more fastener openings 1610. The fastener openings 1610 may be configured to receive a fastener and the faster may attach a brace member to the leg 1600.

Figure 17B:
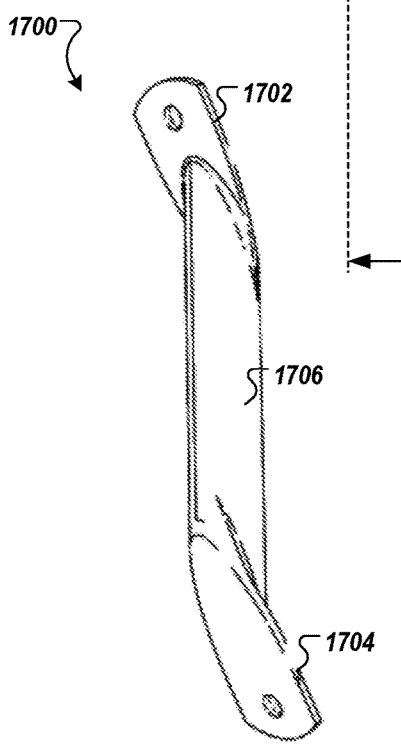
FIGS. 17A and 17B illustrate an exemplary brace member and the brace member may be implemented in an exemplary leg assembly.
Figure 17A:
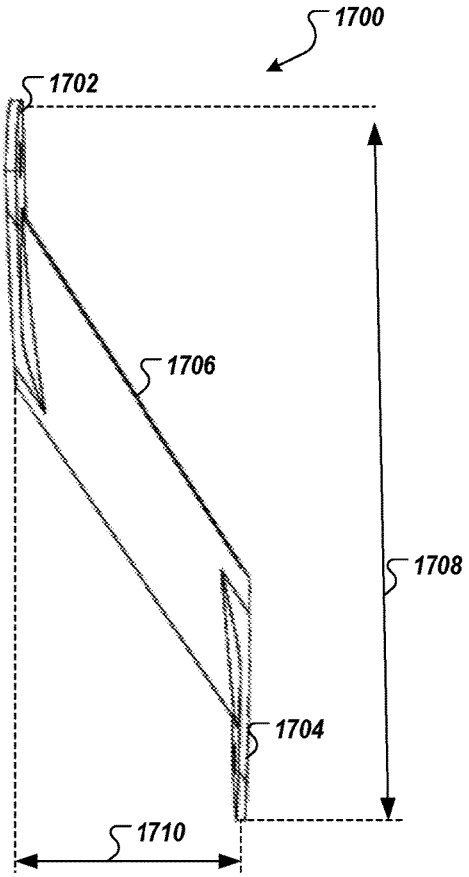

FIGS. 17A and 17B illustrate an exemplary brace member 1700 that may be implemented in a leg assembly, such as the first leg assembly 200A or the second leg assembly 200B. FIG. 17A is a first perspective view of the brace member 1700. FIG. 17B is a second perspective view of the brace member 1700. The brace member 1700 may be configured to be disposed between a frame (e.g., frame 111) and an outer portion of the translation mechanism (e.g., translation mechanism 114). For instance, the brace member 1700 may be configured to be rotatably attached to the frame and rotatably attached to the translation mechanism.

The brace member 1700 may include two ends 1702 and 1704, which may define an opening. The ends may be attached to the frame and the translation mechanism, respectively. The ends 1702 and 1704 may be disposed substantially parallel to one another in some embodiments. The ends 1702 and 1704 may be connected by a brace end connector 1706. The brace end connector 1706 may be angled between or otherwise attach the ends 1702 and 1704. The angle of the brace end connector 1706 may be relative to the ends 1702 and 1704 and length of the brace end connector 1706 may determine a length 1708 (FIG. 17A) and a width 1710 (FIG. 17A) of the brace member 1700. The length 1708 of the brace end connector 1706 may be sized such that the translation member can smoothly translate relative to the support element (e.g., 112) as the support element rotates between the first position and the second position. The width 1710 of the brace end connector 1706 may be sized based on a lateral frame dimension (e.g., 205) and a distance between the translation members.

For purposes of promoting an understanding of the present disclosure, reference will now be made to the following embodiments and specific language will be used to describe the same. It will nevertheless be understood that no limitation of the scope of the disclosure is thereby intended, such alterations and further modifications in the described subject matter, and such further applications of the disclosed principles as described herein being contemplated as would normally occur to one skilled in the art to which the disclosure relates.

The terms and words used in the following description and claims are not limited to the bibliographical meanings but are merely used to enable a clear and consistent understanding of the disclosure. It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

One of ordinary skill in the art may appreciate after reviewing this disclosure that the tables disclosed herein may have a number of different aspects, features, characteristics, and configurations. Further, a table may have any suitable number of aspects, features, characteristics, and configurations depending, for example, upon the intended use of the table.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a tabletop a frame attached to the tabletop; and a leg assembly comprising:

a support element rotatable relative to the frame between a first position and a second position;

a translation mechanism connected to the support element and the frame, the translation mechanism configured to translate along a portion of the support element as the support element rotates between the first position and the second position; and a lock device sized and configured to be disposed in an engaged arrangement in which the lock device fixes the translation mechanism in a fixed position and sized and configured to be disposed in a disengaged arrangement in which the translation mechanism is not disposed in a fixed position.

2. The table of claim 1, further comprising a brace member rotatably attached to the frame and to the translation mechanism, the brace member disposed between the frame and an outer portion of the translation mechanism;

wherein, when the support element is in the first position, the brace member is disposed at an angle relative to the support element and the frame; and wherein, when the support element is in the second position, the brace member is disposed at least substantially parallel to the frame and the support element.

3. The table of claim 2, wherein:

the tabletop includes a first end, a second end opposite the first end, and a center that is disposed substantially equidistant from the first end and the second end;

the tabletop includes a first distance between the first end and the center;

the support element is rotatably coupled to the frame at a second distance from the first end; and the second distance is between about one-fifth and about one-third of the first distance.

4. The table of claim 3, further comprising:

a first button connected to a first lock tab;

a second button connected to a second lock tab, and a space disposed between the first button and the second button when the lock device is in a locked position;

wherein the first button and/or the second button are drawn into the space to unlock the lock device.

5. The table of claim 1, wherein:

the tabletop includes a first side and a second side opposite the first side;

the frame includes a first longitudinal structure that extends along the first side and a second longitudinal structure that extends along the second side; and a brace member pivotally connected to an inner surface of the first longitudinal structure of the frame and a first outer surface of the translation mechanism, the brace member disposed between the inner surface of the first longitudinal structure of the frame and the first outer surface of the translation mechanism when the leg assembly is in a collapsed position.

6. The table of claim 5, wherein:

the first longitudinal structure being separated from the second longitudinal structure by a lateral frame dimension;

the support element includes two support shafts separated by a shaft support separation distance; and the shaft support separation distance being less than the lateral frame dimension such that the brace member extends in a lateral direction from the frame to one of the two support shafts.

7. The table of claim 1, further comprising:

a first lock tab with an opening, a first resilient member at least partially disposed in the opening of the first lock tab; and a second lack tab with an opening, a second resilient member at least partially disposed in the opening of a second lock tab.

8. The table of claim 1, wherein:

the translation mechanism includes a sleeve that at least partially surrounds the support element;

the support element includes a leg configured to be placed on a surface to support the tabletop; and the sleeve includes a conduit defining a translation volume in which a portion of the leg is disposed.

9. The table of claim 1, wherein:

when the support element is in the first position, the translation mechanism is a first distance from an end structure of the support element;

when the support element is in the second position, the translation mechanism is a second distance from the end structure; and the first position is closer to the end structure than the second position.

10. The table of claim 1, further comprising:

a lateral structure attached to the translation mechanism, the lock device being at least partially disposed in the lateral structure; and a compressible mechanism being disposed in a compressed configuration when the lock device is disposed in an unlocked configuration.

11. The table of claim 10, wherein:

the support element includes two legs or two support shafts;

the translation mechanism includes one or more sleeves that at least partially surrounds the two legs or the two support shafts; and the lateral structure extends from a first leg of the two legs to a second leg of the two legs or from a first support shaft of the two support shafts to a second support shaft of the two support shafts.

12. The table of claim 1, further comprising a compression mechanism (Original) at least partially disposed between a first button of a first lock tab and a second button of a second lock tab.

13. A support assembly, comprising:

a frame including a first longitudinal structure and a second longitudinal structure, the first longitudinal structure separated from the second longitudinal structure by a lateral frame dimension;

a support element rotatably coupled to the first longitudinal structure and the second longitudinal structure;

a translation mechanism configured to translate along a portion of the support element as the support element rotates relative to the frame;

a brace member rotatably attached to the frame and to the translation mechanism; and a lock device sized and configured to be disposed in an engaged arrangement in which the lock device fixes the translation mechanism in a fixed position and sized and configured to be disposed in a disengaged arrangement in which the lock device does not fix the translation mechanism in a fixed position.

14. The support assembly of claim 13, further comprising a compression mechanism at least partially disposed between a button of a first lock tab and a button of a second lock tab;

wherein the support element is rotatable relative to the frame from a first position to a second position; and wherein the lock device is biased in the engaged arrangement when the support element is in the first position.

15. The support assembly of claim 13, wherein the translation mechanism includes a sleeve that at least partially surrounds a portion of the support element.

16. The support assembly of claim 15, wherein:

the support element includes an end structure and an elongated structure that is attached to the end structure; and the sleeve includes a leg configured to be placed on a surface.

17. The support assembly of claim 16, wherein:

when the support element is in a first position, the translation mechanism is a first distance from the end structure;

when the support element is in a second position, the translation mechanism is a second distance from the end structure; and the first distance is closer to the end structure than the second position.

18. The support assembly of claim 17, wherein:

the support element includes an end structure and an elongated structure that is attached to the end structure;

the elongated structure includes a leg configured to be placed on a surface to support the frame; and the sleeve includes a conduit defining a translation volume in which a portion of the leg is disposed.

19. The support assembly of claim 13, further comprising a lateral structure attached to the translation mechanism, the lock device being at least partially disposed in the lateral structure, wherein the lock device includes a compression mechanism configured to withdraw a first lock tab and a second lock tab that extends from the lateral structure into the support element.

20. The support assembly of claim 13, further comprising:

a first opening in a first lock tab, a resilient member of the first lock tab at least partially disposed in the first opening; and a second opening in a second lock tab, a resilient member of the second lock tab at least partially disposed in the second opening;

wherein the support element defines at least a portion of a receiver on an inner surface; and wherein the receiver is sized and shaped to receive a lock tab that extends from the lock device when the lock device is configured in the engaged arrangement.

* * * * *